US012766596B2

(12) United States Patent
Bhogaraju et al.

(10) Patent No.: US 12,766,596 B2
(45) Date of Patent: Oct. 20, 2026

(54) COATED METAL FOIL OF COPPER OR A COPPER ALLOY AND METHOD FOR PRODUCING A COATED METAL FOIL OF COPPER OR A COPPER ALLOY

(71) Applicant: CUNEX GMBH, Ingolstadt (DE)

(72) Inventors: Sri Krishna Bhogaraju, Ingolstadt (DE); Gordon Elger, Ingolstadt (DE)

(73) Assignee: CUNEX GMBH, Ingolstadt (DE)

( * ) Notice: Subject to any disclaimer, the term of this patent is extended or adjusted under 35 U.S.C. 154(b) by 0 days.

(21) Appl. No.: 18/997,754

(22) PCT Filed: Mar. 11, 2024

(86) PCT No.: PCT/EP2024/056403
§ 371 (c)(1),
(2) Date: Jan. 22, 2025

(87) PCT Pub. No.: WO2024/230961
PCT Pub. Date: Nov. 14, 2024

(65) Prior Publication Data

US 2025/0256332 A1 Aug. 14, 2025

(30) Foreign Application Priority Data

May 8, 2023 (EP) ..... 23172088

(51) Int. Cl.
*B22F 7/04* (2006.01)
*B22F 1/052* (2022.01)
(Continued)

(52) U.S. Cl.
CPC ..... *B22F 7/04* (2013.01); *B22F 1/052* (2022.01); *B22F 1/068* (2022.01); *B22F 1/103* (2022.01);
(Continued)

(58) Field of Classification Search
None
See application file for complete search history.

(56) References Cited

U.S. PATENT DOCUMENTS 11,697,155 B2 7/2023 Schwarzer et al.
2006/0258136 A1 11/2006 Li et al.
(Continued)

FOREIGN PATENT DOCUMENTS

CN 104341860 A 2/2015
EP 3 626 785 B1 7/2021
(Continued)

OTHER PUBLICATIONS

Lin, C.T. et al., "Effect of surfactant on casting metalorganic films and writing copper metal patterns," J. Mater. Res., vol. 6, Issue 4, pp. 760-765 (Apr. 1991).
(Continued)

*Primary Examiner* — Anthony M Liang
(74) *Attorney, Agent, or Firm* — Maschoff Brennan

(57) ABSTRACT

A coated metal foil for forming a copper-containing interlayer between a first solid substrate and a second solid substrate or between a solid substrate. The coated metal foil includes a metal foil of copper or of a first copper alloy or of a copper plated nickel-iron alloy. The metal foil has a first surface and a second surface. The metal foil has a composition coated on the first surface and/or the second surface of the metal foil. The composition includes an organic binder and flakes of copper or the first or a second copper alloy. The flakes include internal pores.

16 Claims, 8 Drawing Sheets

(51) Int. Cl.

| | |
|---|---|
| ***B22F 1/068*** | (2022.01) |
| ***B22F 1/103*** | (2022.01) |
| ***B22F 1/16*** | (2022.01) |
| ***B22F 7/06*** | (2006.01) |

(52) U.S. Cl.
CPC ..... *B22F 1/16* (2022.01); *B22F 7/064* (2013.01); *B22F 2007/042* (2013.01); *B22F 2301/10* (2013.01); *B22F 2304/10* (2013.01)

(56) References Cited

U.S. PATENT DOCUMENTS

| | | | |
|---|---|---|---|
| 2023/0005871 | A1 | 1/2023 | Anai et al. |
| 2024/0300215 | A1 | 9/2024 | Furuyama et al. |

FOREIGN PATENT DOCUMENTS

| | | | |
|---|---|---|---|
| WO | 2006/041657 | A2 | 4/2006 |
| WO | 2022/186262 | A1 | 9/2022 |

OTHER PUBLICATIONS

Bhogaraju, S.K. et al., "Novel approach to copper sintering using surface enhanced brass micro flakes for microelectronics packaging," Journal of Alloys and Compounds, vol. 844 (2020).

Bhogaraju, S.K. et al., "Die-Attach Bonding with Etched Micro Brass Metal Pigment Flakes for High-Power Electronics Packaging," ACS Applied Electronic Materials, vol. 3, Issue 10, pp. 4587-4603 (2021).

COATED METAL FOIL OF COPPER OR A COPPER ALLOY AND METHOD FOR PRODUCING A COATED METAL FOIL OF COPPER OR A COPPER ALLOY

The present invention relates to a coated metal foil of copper or a copper alloy for forming a copper-containing interlayer between a first solid substrate and a second solid substrate, a method for producing a coated metal foil of copper or a copper alloy and a use of the coated metal foil of copper or a copper alloy. In the sense of the present invention an interlayer is to be understood as an interconnect layer, i.e. a solid metallic interconnection between the first solid substrate and the second solid substrate.

Die-attach bonding is a key process to realize high-temperature operation of power semiconductor devices. High Pb solders have been a preferred and well established choice over the past decades. However strict regulations concerning hazardous substances restrict the usage of high Pb solders and the few exceptions that exist today are also foreseen to be banned in the near future. With the increase in the usage of wide-bandgap (WBG) semiconductor devices, it is imperative to find sustainable and reliable alternatives both on the economical and the technical fronts. Interconnect materials and technologies need to be able to fulfill the challenging requirements of the WBG semiconductor devices and at the same time need to be economical for enabling mass production.

Currently, there are two established methods to produce high-temperature bonds while benefiting from the comparatively low-temperature bonding temperature: Transient liquid phase (TLP) bonding and particle sintering. Although various studies reported successful production of an in-situ phase with a higher re-melting point, thermo-mechanical fracture behavior of TLP bonded joint appeared to have a major drawback. That is due to microstructure of the TLP bonded joint as it is made of brittle intermetallic compounds (IMCs). However, for the case of particle sintering, there are promising reports that suggest Ag-sintered joint as a candidate for high-temperature WBG applications. During sintering, it is possible to realize a connection, which consists of one metal throughout. Beside the high thermal conductivity of the material, the advantage is that the interconnect is established at relative low temperature (250° C.) but is stable at higher temperature (over 300° C.). However, sintered Ag particles have its own drawbacks: High cost and low-electromigration resistance.

Copper is approximately 100 times cheaper than silver and also more abundant, easily recyclable and easily available. Copper has an overall lower carbon footprint than silver. It has a lower co-efficient of thermal expansion than silver and has nearly the same electrical and thermal conductivities. However, the higher melting point of copper means that the sintering temperatures are also slightly higher than in case of silver. Furthermore, the susceptibility to oxidize quickly under atmosphere is a major drawback when using copper as this is detrimental to the mechanical and thermal integrity of the joint.

According to Bhogaraju, S. K. et al. "Novel approach to copper sintering using surface enhanced brass micro flakes for microelectronics packaging", Journal of Alloys and Compounds, Volume 844, 2020, 156043, etched copper or brass flakes were mixed with PEG600 as binder to obtain paste formulations. Before making the paste formulations, the flakes were treated with 12 M HCl for etching Zinc from the brass flakes and copper oxides from the copper flakes. After etching, the flakes were thoroughly rinsed first in distilled water and then in isopropanol. This treatment removed zinc, chlorine and all organic components from the flakes. The use of PEG600 in the paste formulations was reported to enable the in situ reduction of Cu oxides during sintering.

Bhogaraju, S. K. et al. "Die-attach bonding with etched micro brass metal pigment flakes for high-power electronics packaging", ACS Appl. Electron. Mater. 2021, 3, 10, 4587-4603, discloses sinter pastes composed of etched microscale brass metal pigment flakes or pure copper flakes and a binder mixture of alpha-terpineol and polyethylene glycol 600 (PEG600). Before formulation of the pastes, the flakes were treated with HCl for etching, washed in distilled water, washed in isopropanol and dried in air. This treatment removed zinc, chlorine and all organic components from the flakes.

EP 3 626 785 B1 discloses a metal paste comprising 65 to 85% by weight of metal particles and 10 to 35% by weight of organic solvent, wherein 70 to 100% by weight of the metal particles consist of organically coated copper flakes comprising a specific surface in the range of 1.9 to 3.7 $m^2/g$, a total oxygen content in the range of 2 to 4% by weight, and a total carbon to total oxygen weight ratio in the range of 0.25 to 0.9. The proportion of organic coating can be in the range of 2 to 5% by weight, based on the weight of the organically coated copper flakes.

WO 2006/041657 A2 discloses a method for the fabrication of a conductive feature on a substrate, said method comprising the steps of: (a) providing a precursor composition comprising a copper metal precursor compound, wherein said precursor composition has a viscosity not greater than 1000 centipoise; (b) depositing said precursor composition on said substrate using a direct-write tool; and (c) heating said precursor composition to a conversion temperature of not greater than about 350° C. to form a conductive feature having a resistivity of not greater than about 40 times the resistivity of bulk copper. Said substrate may be selected from the group consisting of polyfluorinated compounds, polyimides, epoxies (including glass-filled epoxy), polycarbonate, cellulose-based materials (i.e. wood or paper), acetate, polyester, polyethylene, polypropylene, polyvinyl chloride, acrylonitrile, butadiene (ABS), flexible fiber board, non-woven polymeric fabric, cloth, and metallic foil, semiconductors, ceramics, glass and combinations thereof. Furthermore, a method for the fabrication of a copper conductive feature on a substrate surface is disclosed, comprising the steps of: (a) providing a precursor composition comprising a copper metal precursor compound, wherein said precursor composition has a viscosity not greater than 100 centipoise; (b) depositing said precursor composition on said substrate using an aerosol jet device to form a trace having a minimum size of not greater than about 100 microns; and (c) heating said precursor composition to a temperature of not greater than about 250° C. to form a conductive feature having a minimum feature size of not greater than about 100 microns and a resistivity of not greater than about 100 times the resistivity of bulk copper metal.

Lin C. T. et al. "Effect of surfactant on casting metalorganic films and writing copper metal patterns", J. Mater. Res., 6(4), April 1991, 760-765, discloses the introduction of Triton X-100 detergent to metalorganic solutions and application of the detergent/metalorganic solution to a substrate to form a uniform spin-on thin film. The precursor, copper formate film, is spin-deposited with a metalorganic solution prepared by a solvent mixture of methanol and Triton X-100

(50:1 by volume). Using a KrF laser (248 nm) direct writing of copper patterns on glass and polyimide substrates has been achieved.

CN 104341860 A discloses a nanometer conductive ink comprising an organic copper salt, a solvent, a surfactant and nanometer metal conductive particles and a preparing method thereof. The preparing method includes: a first step of uniformly mixing the organic copper salt, the solvent, the surfactant and the nanometer metal conductive particles according to a ratio to form a solution; and a second step of filtering the solution obtained in the first step through a screen to obtain the nanometer conductive ink.

US 2006/0258136 A1 discloses a method of forming a metal trace on a substrate. The method includes inkjet printing a chemical ink comprising a metal containing compound on the substrate surface to form an ink drop thereon, and heating the substrate to a suitable elevated temperature. The ink drop undergoes at least one of decomposition and reduction due to the substrate temperature to form a metal on the substrate in a controlled atmosphere.

The Die Top System (DTS®) distributed by Heraeus Electronics consists of a copper foil with a NiPdAu-, NiAu- or NiAg plating on one side of the foil and a silver based sinter paste pre-applied to the plating. A die and the DTS® can be sintered together in one step using standard sinter equipment.

The problem to be solved by the present invention is to provide an alternative interconnecting material, a method for producing the alternative interconnecting material and a use of the alternative interconnecting material. The alternative interconnecting material shall allow bonding, in particular for die-top side attach, first level inter-connects, i.e. die to substrate, and second level inter-connects, i.e. substrate to baseplates, the formation of an electrically and/or thermally conductive path on a solid substrate and substrate attachment. The alternative interconnecting material shall enable sintering with short sintering times, with low sintering temperature and/or with low sintering pressure. Sintering of the alternative interconnecting material shall result in a copper-containing interlayer having a very good thermo-mechanical fatigue resistance, a high thermal conductivity and a high electrical conductivity. Furthermore, sintering of the alternative interconnecting material shall result in a homogenous bonding interface.

The problem is solved by the subject-matter of claims 1, 12 and 16. Embodiments of the invention are subject-matter of claims 2 to 11 and 13 to 15.

According to the invention a coated metal foil for forming a copper-containing interlayer between a first solid substrate and a second solid substrate or between a solid substrate and the metal foil is provided. The coated metal foil comprises or consists of a metal foil of copper or of a first copper alloy or of a copper plated nickel-iron alloy, wherein the metal foil has a first surface and a second surface, and a composition coated on the first surface and/or the second surface of the metal foil. The composition comprises or consists of the following components: an organic binder and flakes of copper, of the first copper alloy or of a second copper alloy. The flakes comprise internal pores.

In this application, the term "metal foil" means the metal foil as such, i.e. without the composition coated on the first surface and/or the second surface of the metal foil. However, an organic residue remaining on the foil as a result of a standard production process may be present on the foil. The organic residue may be an oil.

The metal foil with the coating provided by the composition is designated as "coated metal foil". The metal foil and the flakes are formed from elementary metal, i.e. metal in its elementary form and not in its ionic form. The metal is copper or a copper alloy. In case of the metal foil the metal may also be a copper plated nickel-iron alloy. The nickel-iron alloy may be FeNi36 which is generally known as Invar®. The foil of copper plated nickel-iron alloy is usually coated on both sides with copper. Such a foil based on FeNi36 is of specific interest for low coefficient of thermal expansion applications. It can be a commercially available foil, e.g. a CIC (copper/Invar®/copper) foil where the core layer is made of ironnickel alloy with 36% nickel content and represents 60% of the volume of the composite material. The copper on either side represents 20% of the volume of the composite. Such a foil can be commercially procured as CIC 20/60/20 from Schlenk Metallfolien GmbH & Co. KG, Germany.

The inventors of the present invention found that the coated metal foil according to the invention can be manufactured by using standard metal foils with various material properties, e.g. various tensile strengths or thickness. It is very advantageous that the material properties of the coated metal foil according to the invention can be fine-tuned in this way and thus adapted to the requirements of its desired application. The material properties of the metal foil can be complemented by providing a porous microstructure through the coating of the metal foil with the composition comprising the flakes having the internal pores. The thickness of the coating can be varied independently on either side of the metal foil by suitable standard application methods such as screen printing, stencil printing, spray coating or spin coating. All this enables a fine-tuning of the interconnect, its thickness and its thermo-mechanical fatigue resistance. Thereby application specific and/or package specific requirements can be met.

Furthermore, the coated metal foil according to the invention enables sintering with short sintering times, with low sintering temperature and/or with low sintering pressure. Since the organic binder usually evaporates or decomposes at a temperature applied before or at the beginning of the sintering process, the coated copper-containing metal foil according to the invention enables sintering with low residual organics. Thus, the coated metal foil can also be used in specific applications, in which a relatively low sintering pressure, in particular a pressure of at most 250 kPa, and a relatively low sintering temperature, in particular a temperature of at most 260° C., are applied. For miniaturization in specific applications, for example in batteries or high power light emitting diodes, the metal foil may be an ultrathin metal foil having a thickness of less than 10 μm. On this foil a thin layer of the composition can be applied to the first surface and/or the second surface to create a low bond line thickness, such as a bond line thickness of less than 5 μm. The bond line thickness is the thickness of the interlayer between the first solid substrate and the second solid substrate.

The composition may be coated on the first surface and a further composition may be coated on the second surface. The further composition comprises or consists of the organic binder or a further organic binder and the flakes or further flakes of copper, of the first copper alloy or of the second copper alloy, wherein the further flakes comprise internal pores.

By coating the first surface with the composition and the second surface with the further composition, it is possible to adapt each of these compositions to the specific requirements of each of the surfaces. For example, the composition can be composed such that it is more suitable to reduce copper oxides in-situ during a method for producing the coated metal foil than the further composition when the first surface is in a more oxidized condition than the second surface. In such a case, the further composition does not have to contain as much reducing organic binder, such as a diol or a polymeric glycol, as the composition.

Grains in the metal foil at the first surface and/or the second surface of the metal foil may have an average grain size of at least 2 μm and at most 100 μm. Grains in the flakes and/or the further flakes independently from each other may have an average grain size of at least 5 nm and at most 200 nm, in particular at least 20 nm and at most 200 nm. A grain is any of the crystallites that compose a solid metal.

In case of the first surface and/or the second surface this metal is the copper or first or second copper alloy.

The term "average grain size" means the average grain size given as average diameter determined from average area determined according to ISO/DIS 13067(en) by Electron Backscatter Diffraction (EBSD). It is a value determined from a two dimensional measurement which is related to the average three dimensional size of a collection of grains or crystals forming a polycrystalline material by stereological relationships. The collection of grains or crystals may comprise 30 to 1000, in particular 40 to 400, in particular 50 to 200 grains or crystals.

Grain boundaries act as pathways for atomic or molecular diffusion during sintering. During sintering, as sintering temperature is applied, atoms or molecules migrate across these boundaries, which improves diffusion and thus the sintering process. The given average grain sizes have been found to result in a relative fast sintering and a relative high densification rate.

In an embodiment a ratio of the average grain size of the grains in the flakes to the average grain size of the grains at the first surface and/or the second surface of the metal foil and/or of the average grain size of the grains in the further flakes to the average grain size of the grains at the second surface of the metal foil in each case independently from each other does not exceed 0.002.

The effect of this ratio is that it creates an energy variation between the surface of the flakes or further flakes and the first surface and/or the second surface of the metal foil. This is because the flakes or further flakes have in the same volume more grains and thereby also more grain boundaries than the foil at its first and/or second surface and this difference in the number of grain boundaries enhances surface diffusion and sintering between the flakes. The smaller grains of the flakes tend to densify more quickly than the bigger grains at the first surface and/or the second surface of the metal foil. Hence there is a difference between the sintering of the flakes and of the first surface and/or the second surface of the metal foil. In this way, it is possible to maintain the mechanical properties of the copper foil and contributing to it with the mechanical properties of the sintered flakes.

The first copper alloy may be bronze or brass. If the metal from which the metal foil is formed is the first copper alloy, a good thermal conductivity of the coated metal foil according to the invention is enabled. A higher thermal conductivity of the coated metal foil according to the invention can be obtained when the metal from which the metal foil is formed is copper. The brass may be a brass containing at least 0.5 wt. % zinc, in particular at least 1 wt. % zinc, and at most 36 wt. % zinc, in particular at most 30 wt. % zinc, in particular at most 25 wt. % zinc, in particular at most 20 wt. % zinc, in particular at most 15 wt. % zinc. In particular, the brass may be alpha-brass containing at most 36 wt. % zinc. The bronze may be a bronze containing at least 0.5 wt. % tin, in particular at least 1 wt. % tin, and at most 20 wt. % tin, in particular at most 15 wt. % tin, in particular at most 10 wt. % tin, in particular at most 5 wt. % tin. The purity of the copper or first copper alloy may be at least 93%, in particular at least 95%, in particular at least 99%, in particular at least 99.95%, and at most 99.99%.

The metal foil may have a thickness of at least 5 μm, in particular of at least 10 μm, in particular of at least 25 μm, in particular of at least 50 μm, and of at most 200 μm, in particular at most 150 μm, in particular at most 100 μm, in particular of at most 75 μm. In case of large area bonding, e.g. on an area of 1000 $mm^2$ or higher, and in case of applications that are likely to be exposed to high thermo-mechanical stress during the operational lifetime generally a bond line thickness of more than 100 μm is desired. A reason for this desire is that such a thickness can compensate for relatively high warpage existing in surfaces of the first solid substrate and a second solid substrate to be connected and for relatively high inhomogeneities on these surfaces. The first solid substrate may be an electronic component and/or the second solid substrate may be a baseplate, for example. Furthermore, a bond line thickness of more than 100 μm has a good ability to handle high thermo-mechanical stress between the first substrate and the second substrate.

The inventors of the present invention found that a bond line thickness of more than 100 μm can be provided if the metal foil has a relatively high thickness, in particular a thickness of at least 80, 90 or 100 μm and the composition is coated on the first surface and/or on the second surface in a relatively low thickness, in particular a thickness of less than 10 μm.

Alternatively, the thermo-mechanical fatigue resistance can be adjusted by varying the porosity in the sintered composition and/or further composition coated on the first surface and/or the second surface of the metal foil.

Porosity of the sintered composition and/or further composition can be varied by varying sintering parameters either individually or in combination. For example, if sintering is performed for 3 min instead of 5 min, the porosity will be generally higher. Similarly, if during sintering a pressure of only 1 MPa instead of 20 MPa is applied, the porosity will be higher. Also if sintering is performed at 250° C. instead of 300° C., the porosity will be higher.

In addition or independently from the variation of the porosity in the sintered composition and/or further composition, the metal foil and the thickness of the metal foil can be chosen such that it has the desired strength. Hence, both strategies can be utilized either in combination or in isolation depending on the design and application requirements. State of the art for the mentioned large area interconnects is the use of either a solder paste or a sinter paste printed in a thickness of 150-400 μm and therefore requiring a relatively long pre-drying time and also causing voiding after soldering/sintering.

Compared to the solder paste or a sinter paste used in relatively high thickness in the art such a coated metal foil shows a good sinterability and enables a relatively fast sintering process, with a relatively low amount of the organic binder compared to a bond line of same thickness solely provided by use of a sintering paste. The amount of organic binder can be even more reduced when the coated metal foil is pre-dried before the sintering process. A low amount of organic binder results in a uniform interlayer having little or even no unwanted irregular cavities within the interlayer. This is particularly advantageous in case of large area bonding in which a bond thickness of at least 100

μm is desired and in which a relatively high amount of organic binder usually results in formation of a relatively high amount of unwanted irregular cavities and voids. Such cavities and voids result in reduced reliability, thermal conductivity and electrical conductivity of the interlayer and in localized heat spots during operation.

The metal foil, in particular the metal foil of copper, may be a single crystal metal foil or a polycrystalline metal foil. The first surface and/or the second surface of the metal foil may be fully or partially oriented in a single crystallographic orientation, in particular in a 111 crystallographic orientation, or may have a fully or partially disordered crystal structure.

The metal foil can be purchased for example as high tensile alloy copper foil (e.g. HTA-520, HTA-600, HTA-750), as ultra-smooth copper foil or as roll clad/plain copper foil, which are all offered by the company Schlenk Metallfolien GmbH & Co. KG.

The flakes and/or the further flakes are formed from copper or the first or the second copper alloy. The first or second copper alloy may be bronze or brass. If the flakes and/or the further flakes are formed from the first or the second copper alloy instead of copper, a good thermal conductivity of the coated metal foil according to the invention is still enabled, in particular if the first or the second copper alloy is bronze or brass. A higher thermal conductivity of the coated metal foil according to the invention can be obtained when the flakes are formed from copper. The brass may be a brass containing at least 0.5 wt. % zinc, in particular at least 1 wt. % zinc, and at most 36 wt. % zinc, in particular at most 30 wt. % zinc, in particular at most 25 wt. % zinc, in particular at most 20 wt. % zinc, in particular at most 15 wt. % zinc.

In particular, the brass may be alpha-brass containing at most 36 wt. % zinc. In particular, the bronze may be a bronze containing at least 0.5 wt. % tin, in particular at least 1 wt. % tin, and at most 20 wt. % tin, in particular at most 15 wt. % tin, in particular at most 10 wt. % tin, in particular at most 5 wt. % tin. The purity of the copper or the first or the second copper alloy may be at least 93%, in particular at least 95%, in particular at least 99%, in particular at least 99.95%, and at most 99.99%.

The flakes and/or the further flakes may have a mean particle size D50 determined by laser granulometry of at least 1 μm, in particular at least 2 μm, in particular at least 2.5 μm, in particular at least 3 μm, and at most 10 μm, in particular at most 7 μm, in particular at most 5 μm, in particular at most 4 μm in particular at most 3.4 μm. The laser granulometry may be performed by use of laser diffraction measurement according to the specifications of ISO 13320 "Particle size analysis-laser diffraction methods". The laser diffraction measurement can be performed by means of a Helos™ laser diffractometer from the company Sympatec GmbH, 38678 Clausthal-Zellerfeld, Germany. The mean particle size D50 is the corresponding particle size when the cumulative percentage reaches 50%. For example, for a powder sample with D50=50 μm, it means 50% of particles are larger than 50 μm and 50% particles are smaller than 50 μm.

The flakes, in particular the flakes of copper, may be single crystal flakes or polycrystalline flakes. The copper flakes may be fully or partially oriented in a single crystallographic orientation, in particular in a 111 crystallographic orientation, or may have a fully or partially disordered crystal structure.

The flakes may be obtained by grinding in a ball mill and may have a lamellar shape, an irregular shape or a cornflake-like shape. The inventors of the present invention found that the lamellar shape, the irregular shape or the cornflake-like shape of the flakes, in particular of the flakes having a mean particle size D50 of at most 5 μm, in particular a mean particle size D50 of at most 4 μm, in particular a mean particle size D50 of at most 3.4 μm, in particular a mean particle size D50 of at most 3 μm, results in better contact surfaces compared to spherical microparticles due to the ability of the flakes to closely pack over each other, even under the application of a low bonding force, e.g. a bonding force of less than 1 MPa. The lamellar shape, the irregular shape or the cornflake-like shape of the flakes together with the relatively low thickness of the flakes also results in a relatively large surface area of the flakes, which leads to improved densification and coarsening of the flakes during sintering. This further promotes the formation of sintering necks and allow material transport during sintering. Any one of the flakes may independently from each other have a thickness in the range of 5 nm to 400 nm, in particular in the range of 20 nm to 350 nm, in particular in the range of 50 nm to 300 nm, in particular in the range of 100 nm to 275 nm, in particular in the range of 150 nm to 250 nm, in particular in the range of 175 nm to 200 nm.

The flakes and/or the further flakes comprise internal pores. An internal pore is defined as void space in a flake or further flake which is not filled with the copper or first or second copper alloy forming the flake. Any of the internal pores is present within a grain of the copper or first or second copper alloy forming the flakes and/or the further flakes. Any one of the internal pores may have a diameter in the range of 2 nm to 30 nm, in particular in the range of 3 nm to 25 nm, in particular in the range of 5 nm to 20 nm, in particular in the range of 10 nm to 15 nm. The diameter of an internal pore can be measured for example by image-based analysis of transmission electron microscopic (TEM) or scanning electron microscopy (SEM) images. The inventors of the present invention found that the internal pores do not shrink during sintering, unlike the inter-particle pores and hence allow a relatively high stress absorption, in particular a relatively high thermo-mechanical and/or mechanical stress absorption, in case of changing temperatures and/or pressures applied on the interlayer formed from the coated metal foil. This stress absorption by the internal pores of the flakes or further flakes procures a relatively high resistance against thermo-mechanical fatigue and thus a good thermo-mechanical performance of the interlayer formed from the coated metal foil. The internal pores also limit crack propagation during operational life time of the interlayer. In the context of the present invention, thermo-mechanical stress refers to the stress generated in the interlayer due to a mismatch in coefficients of thermal expansion, i.e. due to different expansion and shrinkage of the first and the second solid substrate and the interlayer caused by thermal effects during and after sintering and/or during operation of a device containing the interlayer between the first and the second solid substrate. The inventors found that the combination of the metal foil with the coating comprising the flakes and/or further flakes with internal pores is particular advantageous with respect to the high thermo-mechanical stress absorption of an interlayer formed between the first solid substrate and the second solid substrate, in particular if the foil is coated on the first surface and the second surface. The reason for that is that the metal foil in addition to the flakes or further flakes with the internal pores provides very good thermo-mechanical fatigue resistance as an interconnect/interlayer. This is further enhanced by the fact that the composition on the first surface and the further composition on the second surface of the foil can be different, thereby allowing for a precise adaptation according to the design specifications, requirements and coefficient of thermal expansion (CTE) of the first solid substrate and the second solid substrate.

Furthermore, the inventors of the present invention found that also mechanical stress applied to the interlayer is efficiently absorbed by an interlayer resulting from the coated metal foil according to the invention which coated metal foil comprises the flakes and/or the further flakes comprising the internal pores, compared to an interlayer obtained with flakes of copper or a copper alloy without internal pores. The interlayer resulting from the coated metal foil according to the invention after sintering shows an improved resistance against thermo-mechanical fatigue compared to interlayers resulting from a coated metal foil of copper or a copper alloy comprising flakes of copper or a copper alloy without internal pores. In the context of the present invention, thermo-mechanical fatigue refers to the overlay of a cyclical mechanical loading, that leads to fatigue of a material, with a cyclical thermal loading. Thus, the interlayer resulting from the coated metal foil according to the invention shows a good thermo-mechanical performance, in particular if a relatively high thermo-mechanical stress and/or a relatively high mechanical stress is applied on the interlayer, and thus ensures a good reliability.

The flakes and/or the further flakes of copper, of the first copper alloy or of the second copper alloy may have a mean intraparticle pore density in a range of 2 internal pores/$\mu m^2$ to 40 internal pores/$\mu m^2$, in particular in a range of 2 internal pores/$\mu m^2$ to 30 internal pores/$\mu m^2$, in particular in a range of 3 internal pores/$\mu m^2$ to 25 internal pores/$\mu m^2$, in particular in a range of 5 internal pores/$\mu m^2$ to 20 internal pores/$\mu m^2$, in particular in a range of 7 internal pores/$\mu m^2$ to 18 internal pores/$\mu m^2$, in particular in a range of 10 internal pores/$\mu m^2$ to 15 internal pores/$\mu m^2$, in particular in a range of 12 internal pores/$\mu m^2$ to 13 internal pores/$\mu m^2$, in an arbitrary section, in particular in any arbitrary section, through any of the flakes or the further flakes. In an embodiment, the flakes and/or the further flakes, in particular only the flakes, of copper, of the first copper alloy or of the second copper alloy have a mean intraparticle pore density in a range of 7 internal pores/$\mu m^2$ to 40 internal pores/$\mu m^2$, in particular of 7 internal pores/$\mu m^2$ to 30 internal pores/$\mu m^2$. In the context of the present invention, the mean intraparticle pore density of a flake or further flake is defined as the mean of the number of internal pores in relation to an area of an arbitrary section through this flake or further flake. The inventors of the present invention found that the mean intraparticle pore density of the flakes and/or the further flakes in the composition and/or the further composition as specified according to the invention is not affected by sintering of the coated metal foil according to the invention. Thus, also the sintered flakes and/or the further flakes in the copper-containing interlayer/interconnect layer between the two solid substrates may have a mean intraparticle pore density in the range of 2 internal pores/$\mu m^2$ to 40 internal pores/$\mu m^2$, in particular in the range of 7 internal pores/$\mu m^2$ to 40 internal pores/$\mu m^2$, in particular in the range of 7 internal pores/$\mu m^2$ to 30 internal pores/$\mu m^2$ or in the range of 2 internal pores/$\mu m^2$ to 30 internal pores/$\mu m^2$, in particular in the range of 3 internal pores/$\mu m^2$ to 25 internal pores/$\mu m^2$, in particular in the range of 5 internal pores/$\mu m^2$ to 20 internal pores/$\mu m^2$, in particular in the range of 7 internal pores/$\mu m^2$ to 18 internal pores/$\mu m^2$, in particular in the range of 10 internal pores/$\mu m^2$ to 15 internal pores/$\mu m^2$, in particular in the range of 12 internal pores/$\mu m^2$ to 13 internal pores/$\mu m^2$ in an arbitrary section, in particular in any arbitrary section, through the interlayer/interconnect layer. Though single particles or flakes and/or the further flakes are sintered together in the interlayer/interconnect layer such that no single particles/flakes/further flakes are present in the interlayer/interconnect layer, the term "intraparticle pore density" has been maintained since the origin of the pores is in the particles/flakes/further flakes. The mean intraparticle pore density of the flakes/further flakes can be measured for example by gravimetric analysis, by computed tomographic analysis or by image-based analysis. The mean intraparticle pore density of the flakes/further flakes can be determined for example by using the following method:

1. Embedding the flakes/further flakes in a resin, in particular in an epoxy resin,
2. preparing ultrathin sections of the embedded flakes/further flakes,
3. taking transmission electron microscopic (TEM) images and/or scanning electron microscopy (SEM) images of the ultrathin sections of the embedded flakes/further flakes,
4. determining a plurality of intraparticle pore densities by calculating the number of internal pores within the ultrathin sections of the flakes/further flakes in relation to the total area of these ultrathin sections of the flakes/further flakes, in a plurality of Transmission Electron Microscopy (TEM) images and/or in a plurality of Scanning Electron Microscopy (SEM) images, and
5. calculating the mean of the plurality of intraparticle pore densities determined in this way.

In this connection, step 4 can be effected by means of a computer-assisted image analysis of the TEM images and/or the SEM images.

The inventors of the present invention found that the metal foil coated with the composition and/or further composition comprising the flakes and/or the further flakes of copper, of the first copper alloy or of the second copper alloy having a mean intraparticle pore density in the range of 2 internal pores/$\mu m^2$ to 40 internal pores/$\mu m^2$, in particular in the range of 7 internal pores/$\mu m^2$ to 40 internal pores/$\mu m^2$, in particular in the range of 7 internal pores/$\mu m^2$ to 30 internal pores/$\mu m^2$ or in the range of 2 internal pores/$\mu m^2$ to 30 internal pores/$\mu m^2$, in particular in the range of 5 internal pores/$\mu m^2$ to 20 internal pores/$\mu m^2$, result in an increased resistance against thermo-mechanical fatigue of the interlayer in contrast to that of an interlayer obtained from a metal foil of copper or a copper alloy coated with a composition comprising flakes of copper or a copper alloy having no internal pores. Furthermore, the thermal conductivity and the electrical conductivity of the interlayer obtained from the metal foil coated with the composition and/or further composition comprising the flakes and/or the further flakes having a mean intraparticle pore density in the range of 2 internal pores/$\mu m^2$ to 40 internal pores/$\mu m^2$, in particular in the range of 2 internal pores/$\mu m^2$ to 30 internal pores/$\mu m^2$, in particular in the range of 7 internal pores/$\mu m^2$ to 30 internal pores/$\mu m^2$ or 5 internal pores/$\mu m^2$ to 20 internal pores/$\mu m^2$, is not affected by the internal pores. It is identical or nearly identical to that of an interlayer obtained from the metal foil coated with a composition comprising flakes of copper or a copper alloy having no internal pores. Thus, due to the flakes/further flakes having a mean intraparticle pore density in the range of 2 internal pores/$\mu m^2$ to 40 internal pores/$\mu m^2$, in particular in the range of 2 internal pores/$\mu m^2$ to 30 internal pores/$\mu m^2$, in particular in the range of 7 internal pores/$\mu m^2$ to 30 internal pores/$\mu m^2$ or 5 internal pores/$\mu m^2$ to 20 internal pores/$\mu m^2$, a relatively high thermo-mechanical performance, a relatively high thermal conductivity and a relatively high electrical conductivity of the obtained interlayer is enabled. The mean intraparticle pore density in the range of 2 internal pores/$\mu m^2$ to 40 internal pores/$\mu m^2$, in particular in the range of 2 internal pores/$\mu m^2$ to 30 internal pores/$\mu m^2$, in particular in the range of 7 internal pores/$\mu m^2$ to 30 internal pores/$\mu m^2$ or 5 internal pores/$\mu m^2$ to 20 internal pores/$\mu m^2$, of the flakes/further flakes is not affected by sintering of the composition and/or further composition as specified according to the invention. The resulting relatively high thermo-mechanical performance allows a rapid cooling of the interlayer/interconnect layer from the sintering temperature to a cooling temperature within a short period of time without causing an overstressing of the interlayer, e.g. without fracture formation in the interlayer.

In contrast to the mean intraparticle pore density, the mean interparticle cavity density in the context of the present invention is defined as the mean percentage of area between the sintered flakes/further flakes from the total area in a cross-section of the interlayer formed from the composition or further composition as specified according to the invention. The area between the sintered flakes/further flakes is not filled with metal. The mean interparticle cavity density of the flakes/further flakes in this interlayer, in particular at the beginning of the sintering of the flakes/further flakes, may be in the range of 5% to 50%, in particular in the range of 10% to 45%, in particular in the range of 15% to 40%, in particular in the range of 20% to 35%, in particular in the range of 25% to 30%. The mean interparticle cavity density of the flakes/further flakes in the interlayer can be measured for example by scanning electron microscopy (SEM) analysis, by computed tomographic analysis or by image-based analysis of cross-sections of the interlayer. In this regard, cross-sections of the interlayer can be prepared by ion beam milling to avoid smudging or clogging of the internal pores and/or of the interparticle cavities. The mean interparticle cavity density of the flakes/further flakes in the interlayer can be determined for example by using the following method:

1. Preparing ultrathin sections of the interlayer,
2. taking SEM images of these ultrathin sections,
3. determining a plurality of interparticle cavity densities by calculating the area between the flakes/further flakes that is not filled with metal within the ultrathin sections in relation to the total area of these ultrathin sections of the interlayer in a plurality of SEM images, and
4. calculating the mean of the plurality of interparticle cavity densities which have been determined in this way.

In this connection, step 3 can be effected by means of a computer-assisted image analysis of the SEM images.

The inventors of the present invention found that although the mean intraparticle pore density of the flakes/further flakes is not affected during sintering of the coated metal foil according to the invention, the mean interparticle cavity density of the flakes/further flakes in the coated composition or further composition as specified according to the invention decreases during sintering of the coated metal foil according to the invention. In this regard, the decrease in the mean interparticle cavity density is dependent on the sintering time, the pressure applied during sintering and the sintering temperature. The pressure applied during sintering of the coated metal foil between a first solid substrate and a second solid substrate is usually a bonding pressure applied to press the first substrate and the second substrate against one another. A relatively long sintering time, a relatively high pressure applied during sintering and/or a relatively high sintering temperature results in a relatively high decrease in the mean interparticle cavity density. After sintering of the coated metal foil according to the invention, the mean interparticle cavity density in the copper-containing interlayer/interconnect layer, in particular between the sintered flakes/further flakes in the copper-containing interlayer/interconnect layer, may be in the range of 0.5% to 45%, in particular in the range of 1% to 45%, in particular in the range of 5% to 40%, in particular in the range of 10% to 35%, in particular in the range of 15% to 30%, in particular in the range of 20% to 25%. The decrease in the mean interparticle cavity density during sintering of the coated metal foil according to the invention can result in the total or nearly total disappearance of interparticle pores in the copper-containing interlayer/interconnect layer, in particular between the sintered flakes/further flakes in the copper-containing interlayer/interconnect layer.

The flakes/further flakes stack in uniform stacking patterns, in particular by horizontally stacking over each other. Thus, a relatively large surface contact between these flakes/further flakes is provided. The relatively large surface contact between the flakes/further flakes allows sintering within a relatively short sintering time, at a relatively low sintering pressure and/or at a relatively low sintering temperature. Furthermore, the flakes/further flakes show a relatively high surface energy. The surface energy can be defined as the excess energy at the surface of a material compared to the bulk of the material.

The flakes/further flakes can be purchased for example as Cubrotec 8000 copper flakes or Cubrotec 8001 copper flakes, which are both offered by the company Carl Schlenk SE, Germany.

The flakes and/or the further flakes may have a multi-layer lamellar structure, i.e. a structure in which multiple smaller flakes forming lamellas are stacking over each other loosely but held together by van der Waals forces. The overall thickness of this structure preferably does not exceed 200 nm. The inventors of the present invention found that the flakes and/or the further flakes of copper or a copper alloy having a multi-layer lamellar structure enable sintering within a relatively short sintering time, in particular within a sintering time of at most 5 minutes, with a relatively low sintering temperature, in particular with a sintering temperature of at most 250° C., and/or with a relatively low sintering pressure, in particular with a sintering pressure of at most 15 MPa, compared to flakes of copper or a copper alloy having no lamellar structure, in particular having no multi-layer lamellar structure. This is enabled by the relatively large surface area of the flakes and/or the further flakes having a multi-layer lamellar structure which results in improved densification and rapid grain growth of the flakes and/or the further flakes in the composition and/or further composition during sintering. The multi-layer lamellar structure of a flake or a further flake can be determined by surface analysis, in particular by metal surface analysis, comprising the methods as indicated above, and/or by analysis of cross-sections of the flakes or further flakes. The analysis of cross-sections can be performed for example by scanning electron microscopy (SEM), scanning tunneling microscopy (STM), transmission electron microscopy (TEM), glow discharge spectrometry and image-based metal surface inspection. These methods can also be applied to the analysis of cross-sections of the copper-containing interlayer, cross-sections of the coated metal foil according to the invention, cross-sections of the metal foil and/or cross-sections of the composition or further composition as specified according to the invention before and/or after sintering, respectively.

The multi-layer lamellar structure may comprise or consist of at least two, in particular at least three, in particular at least four, in particular at least five, in particular at least six, in particular at least seven, in particular at least eight, and of at most 20, in particular at most 18, in particular at most 16, in particular at most 14, in particular at most 12, in particular at most 11, in particular at most ten, in particular at most nine, lamellas. Any one of the lamellas may independently from each other have a thickness in the range of 5 nm to 20 nm, in particular in the range of 6 nm to 18 nm, in particular in the range of 8 nm to 16 nm, in particular in the range of 10 nm to 14 nm, in particular in the range of 11 nm to 13 nm. The number of lamellas in the multi-layer lamellar structure and/or the thickness of any of the lamellas in the multi-layer lamellar structure can be determined by analysis of cross-sections of the flakes/further flakes. The analysis of cross-sections can be performed for example by SEM or TEM of cross-sections of the flakes/further flakes.

The number of lamellas in the multi-layer lamellar structure of the flakes/further flakes can be determined for example by using the following method:

1. Embedding the flakes/further flakes in a resin, in particular in an epoxy resin,
2. preparing ultrathin sections of the embedded flakes/further flakes,
3. taking transmission electron microscopic (TEM) images and/or scanning electron microscopy (SEM) images of the ultrathin sections of the embedded flakes/further flakes, and
4. counting the number of lamellas in a multi-layer lamellar structure within the ultrathin sections of the flakes/further flakes in the TEM images and/or in the SEM images.

In this connection, step 4 can be effected by means of a computer-assisted image analysis of the TEM images and/or the SEM images.

The multi-layer lamellar structure may extend over the entire flake or over a portion of the flake. The multi-layer lamellar structure may have a total thickness of at least 20 nm, in particular at least 50 nm, in particular at least 100 nm, and of at most 400 nm, in particular at most 350 nm, in particular at most 300 nm, in particular at most 250 nm, in particular at most 200 nm.

The copper or copper alloy forming the lamellas may have a nanocrystalline structure comprising or consisting of nanoscale grains. The copper or copper alloy forming the lamellas may be identical to the copper or copper alloy forming the flakes/further flakes. The nanoscale grain size may be in the range of 5 nm to 200 nm, in particular in the range of 5 nm to 100 nm, in particular in the range of 10 nm to 90 nm, in particular in the range of 15 nm to 80 nm, in particular in the range of 20 nm to 70 nm, in particular in the range of 25 nm to 60 nm, in particular in the range of 30 nm to 50 nm, in particular in the range of 35 nm to 40 nm. If the metal forming the lamellas, i.e. the copper or the first or second copper alloy, has a nanocrystalline structure comprising or consisting of nanoscale grains, rapid grain growth of the flakes/further flakes is enabled during sintering. In this regard, the rapid grain growth is particularly pronounced during the later stages of sintering, when the interparticle cavity density decreases and interparticle pores of the flakes/further flakes in the copper-containing interlayer/interconnect layer totally or nearly totally disappear, while intraparticle pores remain. In those later stages of sintering, grain boundary migration becomes the dominant process mechanism for grain growth which is particularly pronounced, if the metal forming the lamellas has a nanocrystalline structure comprising or consisting of nanoscale grains. Thus, sintering within a relatively short sintering time, with a relatively low sintering pressure and/or with a relatively low sintering temperature is facilitated, if the metal forming the lamellas has a nanocrystalline structure comprising or consisting of nanoscale grains. The grain structure can be detected and analyzed, e.g., by use of Electron Backscatter Diffraction (EBSD) analysis of the flakes/further flakes.

Within the multi-layer lamellar structure, each of the lamellas may be in contact with (an)other lamella(s) by at least one lamellar boundary. Furthermore, lamellas may be part of one layer bend around at the edge of the flake. This means that the lamellas form a unit in the form of the flake having the multi-layer lamellar structure.

The flakes and/or the further flakes may be coated with stearic acid. The total weight of stearic acid in relation to the total weight of the flakes coated with stearic acid and/or of the further flakes coated with stearic acid may be in each case independently from each other at least 0.001 wt. %, in particular at least 0.005 wt. %, in particular at least 0.01 wt. %, in particular at least 0.05 wt. %, in particular at least 0.075 wt. %, and at most 1.5 wt. %, in particular at most 1.25 wt. %, in particular at most 1 wt. %, in particular at most 0.75 wt. %, in particular at most 0.5 wt. %, in particular at most 0.25 wt. %, in particular at most 0.1 wt. %. In particular, the total weight of stearic acid in relation to the total weight of the flakes and/or of the further flakes coated with stearic acid may be in each case independently from each other at most 1.5 wt. %. The inventors of the present invention found that the stearic acid coated on the surface of the flakes or further flakes prevents an agglomeration and cold welding of the flakes or further flakes. However, due to the boiling point of 361° C., this stearic acid on the surface of the flakes or further flakes does not evaporate completely during sintering at a relatively low temperature and a relatively short sintering duration. Copper-containing particles coated with an organic coating agent, in particular stearic acid, normally demonstrate a relatively low sintering efficacy. The inventors of the present invention found that a relatively low sintering efficacy occurs only if the coated metal foil comprises flakes and/or further flakes coated with a relatively high total weight of stearic acid in relation to the total weight of the flakes and/or further flakes coated with the stearic acid, in particular a total weight of the stearic acid in relation to the total weight of the flakes and/or further flakes coated with stearic acid of more than 1.5 wt. %.

In an embodiment, the total weight of stearic acid in relation to the total weight of the flakes of copper or the copper alloy coated with stearic acid is at least 0.7 wt. % and at most 1.5 wt. %. The total weight of 0.7 wt. % stearic acid in relation to the total weight of the flakes has been found to be high enough to prevent agglomeration and cold welding of the flakes under all relevant ball milling conditions. The total weight of 1.5 wt. % stearic acid in relation to the total weight of the flakes has been found to be low enough for not hindering later sintering. The inventors found that a total weight above this value hinders sintering, as the flakes contain a high organic content, which must first leave the composition containing these flakes before surface diffusion can take place to enable sintering. 1.5 wt. % stearic acid in relation to the total weight of the flakes has been found to be the limit beyond which sintering results are not satisfactory.

The total weight of least 0.001 wt. %, in particular at least 0.005 wt. %, in particular at least 0.01 wt. %, in particular at least 0.05 wt. %, in particular at least 0.075 wt. % stearic acid in relation to the total weight of the flakes has been found to be high enough to prevent agglomeration and cold welding of the flakes under many but not all relevant conditions.

The inventors of the present invention found that the relatively low total weight of stearic acid, i.e. at most 1.5 wt. % stearic acid, in relation to the total weight of the flakes and/or further flakes coated with stearic acid in the composition or further composition is sufficient for preventing agglomeration and cold welding of the flakes and/or further flakes and also improves or at least does not hinder sintering of these flakes. The inventors further found that the composition and/or further composition comprising the flakes and/or further flakes coated with a relatively low total weight of stearic acid, i.e. at most 1.5 wt. % stearic acid, in relation to the total weight of the flakes and/or further flakes coated with stearic acid, shows an improved particle contact during sintering of the coated metal foil in contrast to a coated metal foil of copper or a copper alloy comprising flakes and/or further flakes of copper or a copper alloy coated with a higher total weight of stearic acid, in particular at least 1.6 wt. % stearic acid, in particular at least 2 wt. % stearic acid, in particular at least 4 wt. % stearic acid, in relation to the total weight of the flakes and/or further flakes coated with stearic acid. Thus, the coated metal foil comprising flakes and/or further flakes coated with a relatively low total weight of stearic acid, i.e. at most 1.5 wt. % stearic acid, in relation to the total weight of the flakes and/or further flakes coated with stearic acid enables an improved sintering neck formation and thus allows sintering with short sintering times, with low sintering temperature and/or with low sintering pressure.

Furthermore, in contrast to flakes without an organic coating, in particular flakes without a stearic acid coating, the flakes and/or further flakes coated with a relatively low total weight of stearic acid, i.e. at most 1.5 wt. % stearic acid, in relation to the total weight of the flakes and/or further flakes coated with stearic acid in the composition and/or further composition do not agglomerate, in particular do not agglomerate in a method for forming the composition and/or further composition as specified according to the invention and/or do not agglomerate during storage and if the composition is coated on the first surface and/or the second surface and/or if the further composition is coated on the second surface of the metal foil. Agglomeration hinders formulation of the composition and/or further composition as a paste by forming substantially large clumps that prevent homogeneous mixture of flakes or further flakes and the organic binder or further organic binder. Agglomeration(s) of the flakes or further flakes also result(s) in an inhomogeneous and inconsistent coating of the first surface and/or the second surface of the metal foil by the composition or further composition and also in an insufficient attachment of the coated metal foil to a first substrate and/or a second substrate. This may in particular occur if the composition coated on the first surface and/or the second surface or if the further composition coated on the second surface of the metal foil or the first surface and/or the second surface of the metal foil together with the composition and/or further composition is heated to a pre-drying temperature before sintering. Pre-drying results in an evaporation, in particular a partial evaporation, of the organic binder or further organic binder in the composition or further composition as specified according to the invention and in an evaporation, in particular a partial evaporation, of an optional polar organic solvent or of an optional turpentine in the composition or further composition. This results in case of flakes or further flakes of copper, of the first copper alloy or of the second copper alloy without an organic coating to a pronounced agglomeration of the flakes or further flakes. A pronounced agglomeration of the flakes or further flakes results in an inhomogeneous distribution of the composition or further composition on the first surface and/or the second surface of the metal foil. Furthermore, the contact surface between the coated composition and the first surface and/or the second surface or between the coated further composition and the second surface of the metal foil is relatively small due to the inhomogeneity caused by the agglomerated flakes or further flakes. This results in a non-uniform pressure distribution during sintering of the coated metal foil and thus in a non-uniform sintering of the coated metal foil.

Thus, by preventing the agglomeration of the flakes and/or further flakes in the composition, a homogenous and consistent coating and/or applicability, in particular printability, and a sufficient attachment of the composition on the first surface and/or the second surface and/or of the further composition on the second surface of the metal foil is enabled, in particular if the composition on the first surface and/or the second surface and/or of the further composition on the second surface of the metal foil or the first surface and/or the second surface together with the composition and/or the further composition are heated to a pre-drying temperature before sintering. This is especially important when the composition is applied to the first surface and/or the second surface and/or of the further composition is applied on the second surface of the metal foil in a relatively low thicknesses, e.g. less than 20 μm. Thus, after sintering, a sufficient copper bond between the first substrate and the second substrate with a relatively high arithmetic average shear strength value is enabled by the coated metal foil, in particular if the coated metal foil comprises the flakes and/or further flakes coated with a relatively low total weight of stearic acid, i.e. at most 1.5 wt. % stearic acid, in relation to the total weight of the flakes and/or further flakes coated with stearic acid. Furthermore, a coated metal foil comprising flakes of copper or a copper alloy coated with a higher total weight of stearic acid, in particular at least 1.6 wt. % stearic acid, in particular at least 2 wt. % stearic acid, in particular at least 4 wt. % stearic acid, results in residues of the stearic acid remaining after sintering. The higher total weight of stearic acid also results in the adhesive force of the organic binder to the first surface and/or the second surface and/or of the further organic binder to the second surface of the metal foil being stronger than the cohesive force of the organic binder and/or further organic binder within the composition and/or further composition, resulting in an effect usually designated as bleed-out. Bleed-out of the organic binder or further organic binder results in the organic binder or further organic binder being unevenly distributed on the first surface and/or the second surface of the metal foil, if the composition is coated on the first surface and/or the second surface and/or the further composition is coated on the second surface of the metal foil, and the flakes and/or further flakes being entrained due to the uneven distribution of the organic binder and/or further organic binder on the first surface and/or the second surface of the metal foil. Thus, the composition or further composition as specified according to the invention comprising the flakes or further flakes coated with a relatively low total weight of stearic acid in relation to the total weight of the flakes or further flakes coated with stearic acid, shows an improved processability and an improved sintering efficacy compared to compositions comprising flakes of copper or a copper alloy without an organic coating and compared to compositions comprising flakes of copper or a copper alloy coated with a relatively high total weight of stearic acid, in particular at least 2 wt. % stearic acid, in relation to the total weight of the flakes coated with stearic acid.

The inventors of the present invention found that the sintered flakes and/or further flakes are distributed uniformly in the copper-containing interlayer, in particular between the first surface of the metal foil and the first solid substrate and between the second surface of the metal foil and the second solid substrate, after the sintering process. This allows an efficient formulation of the composition and/or further composition as specified according to the invention, an improved coating and/or applicability, in particular printability, of the composition and/or further composition as specified according to the invention on the first surface and/or the second surface of the metal foil. Furthermore, the coated metal foil according to the invention enables a relatively good surface control of the sintered copper-containing interlayer by ensuring a relatively low surface roughness and an uniform bond thickness of the copper-containing interlayer, in particular during and/or after sintering. Furthermore, if the flakes and/or further flakes are coated with a relatively low total weight of stearic acid, i.e. at most 1.5 wt. % stearic acid, in relation to the total weight of the flakes and/or further flakes coated with stearic acid, agglomeration of the flakes and/or further flakes is prevented and thus, the uniform distribution of the flakes and/or further flakes in the copper-containing interlayer, in particular between the first surface of the metal foil and the first solid substrate and between the second surface of the metal foil and the second solid substrate, after the sintering process is further improved. This further improves the coating and/or applicability, in particular printability, of the composition on the first surface and/or the second surface and/or of the further composition on the second surface of the metal foil. Furthermore, also the surface control of the sintered copper-containing interlayer by ensuring a relatively low surface roughness and an uniform bond thickness of the copper-containing interlayer, in particular during and/or after sintering is further improved, if the flakes and/or further flakes are coated with a relatively low total weight of stearic acid, i.e. at most 1.5 wt. % stearic acid, in relation to the total weight of the flakes and/or further flakes coated with stearic acid.

The inventors of the present invention found that besides the multi-layer lamellar structure of the flakes and/or further flakes, also the following properties of the flakes and/or further flakes in the composition and/or further composition as specified according to the invention each contribute to enabling sintering within a relatively short sintering time, at a relatively low sintering pressure and/or at a relatively low sintering temperature as indicated above: A relatively large surface contact due to the uniform stacking pattern by the flakes in the composition as specified according to the invention and/or the further flakes in the further composition as specified according to the invention and on the first surface and/or the second surface of the metal foil, the metal forming the lamellas of the flakes and/or further flakes having a nanocrystalline structure comprising or consisting of nanoscale grains, and a coating of the flakes and/or further flakes with a relatively low total weight of stearic acid, i.e. at most 1.5 wt. % stearic acid, in relation to the total weight of the flakes and/or further flakes coated with stearic acid. The inventors of the present invention further found that the multi-layer lamellar structure of the flakes and/or further flakes and each of the above properties reinforce each other resulting in a synergistic effect and thus allow sintering within an even shorter sintering time, at an even lower sintering pressure and/or at an even lower sintering temperature, if the flakes and/or further flakes have not only a multi-layer lamellar structure, but also fulfill two of the above properties or even three of the above properties compared to flakes of copper or a copper alloy having no lamellar structure, in particular having no multi-layer lamellar structure, or compared to flakes of copper or a copper alloy only having a multi-layer lamellar structure but not fulfilling any one of the above properties or compared to flakes of copper or a copper alloy having a multi-layer lamellar structure but not fulfilling all of the above properties.

The flakes and/or further flakes may have a total oxygen content in a range of 3 wt. % to 8 wt. %, in particular in a range of 4 wt. % to 7.9 wt. %, in particular in a range of 4.1 wt. % to 7.5 wt. %, in particular in a range of 4.2 wt. % to 7 wt. %, in particular in a range of 4.3 wt. % to 6.5 wt. %, in particular in a range of 4.4 wt. % to 6 wt. %, in particular in a range of 4.5 wt. % to 5.5 wt. %, in particular in a range of 4.6 wt. % to 5 wt. %. In the context of the present invention, the total oxygen content of the flakes and/or further flakes refers to oxygen atoms in any form, e.g. in the form of copper oxide on the surface of the flakes and/or further flakes, as well as the oxygen content of the flakes and/or further flakes themselves, e.g. resulting from oxygen trapped within the internal pores or the lamellar structure. If the flakes and/or further flakes are coated with stearic acid, the total oxygen content also refers to the oxygen content of the stearic acid coating of the flakes/further flakes.

The organic binder and/or the further organic binder may be a liquid organic binder. The organic binder and/or the further organic binder may be in each case independently from each other a terpineol, a primary alcohol, a diol, a triol, a polymeric glycol or a mixture of at least two of a terpineol, a primary alcohol, a diol, a triol and a polymeric glycol. In particular, the terpineol forming the organic binder or the further organic binder may be an alpha-terpineol. The alpha-terpineol may be an (R)-(+)-alpha-terpineol, an (S)-(−)-alpha-terpineol or a mixture an (R)-(+)-alpha-terpineol and an (S)-(−)-alpha-terpineol. The (R)-(+)-alpha-terpineol and/or the (S)-(−)-alpha-terpineol may each have independently from each other a purity of at least 90%, in particular at least 93%. The primary alcohol forming the organic binder may be 1-butanol or 1-octanol. The diol forming the organic binder or the further organic binder may be a diol having an average molar mass of at least 60 g/mol and at most 110 g/mol, in particular ethylene glycol, diethylene glycol, propylene glycol or butylene glycol. The triol forming the organic binder or the further organic binder may be a triol having an average molar mass of at least 75 g/mol and at most 110 g/mol, in particular glycerol. The polymeric glycol forming the organic binder or the further organic binder may be a polymeric ethyl glycol having an average molar mass of at least 200 g/mol, in particular at least 300 g/mol, in particular at least 400 g/mol, in particular at least 500 g/mol, in particular at least 550 g/mol, and at most 800 g/mol, in particular at most 750 g/mol, in particular at most 700 g/mol, in particular at most 650 g/mol.

In the sintering process, the organic binder and/or the further organic binder, in particular a residual organic binder and/or the residual further organic binder, usually evaporates or decomposes. During the evaporation or decomposition of the diol and/or the polymeric glycol, a reducing atmosphere is created which prevents the oxidation of the copper of the coated metal foil to copper oxide without the requirement of providing an additional protective gas atmosphere to be applied from the outside. Therefore, the diol and/or the polymeric glycol in the composition or further composition as specified according to the invention enables the in situ reduction of Cu oxides during the sintering process with little effort. The in-situ reduction of copper oxides, in particular $Cu_2O$, during the sintering process, also results in the formation of copper nanoparticles, which further aid sintering due to their high surface area and reactivity. The organic binder or further organic binder, in particular the polymeric glycol, in particular the polymeric glycol having an average molar mass of at least 550 g/mol and at most 650 g/mol, has a reducing effect on the coated metal foil.

In contrast to polymeric glycols, in particular polymeric ethyl glycol, in particular polymeric ethyl glycol having an average molar mass of more than 200 g/mol, the evaporation of the diol, in particular the diol having an average molar mass of at least 60 g/mol and at most 110 g/mol, and the evaporation of the primary alcohol, in particular 1-butanol and 1-octanol, is achieved at a relatively low temperature, in particular at a temperature of at most 200° C. For example, the evaporation of ethylene glycol is achieved at a temperature of 197° C. For example, the evaporation of 1-butanol is achieved at a temperature of 117.7° C. For example, the evaporation of 1-octanol is achieved at a temperature of 195° C. In order to evaporate the polymeric ethyl glycol, a relatively high temperature of at least 200° C. is necessary. However, evaporation of the organic binder or further organic binder at a relatively high temperature results in the requirement of a relatively high sintering temperature or a relatively long sintering time at a relatively high sintering temperature to enable complete evaporation of the organic binder or further organic binder. With a mixture of ethylene glycol and alpha-terpineol, it is also possible to achieve the combined effect of a relatively low sintering temperature, such as a sintering temperature of less than 250° C., and a relatively fast sintering, such as a sintering in less than 5 minutes, while at the same time making use of the reducing atmosphere.

In one embodiment of the invention, the organic binder or further organic binder may be a mixture of ethylene glycol and alpha-terpineol. In another embodiment of the invention, the organic binder or further organic binder may be a mixture of alpha-terpineol, ethylene glycol and polyethylene glycol. In this mixture, the total weight of the alpha-terpineol in relation to the total weight of the organic binder or further organic binder may be 80 wt. %, the total weight of the ethylene glycol in relation to the total weight of the organic binder or further organic binder may be 18 wt. % and the total weight of the polyethylene glycol in relation to the total weight of the organic binder or further organic binder may be 2 wt. %. In another embodiment of the invention, the organic binder or further organic binder may be a mixture of alpha-terpineol, polyethylene glycol and glycerol. In this mixture, the total weight of the alpha-terpineol in relation to the total weight of the organic binder or further organic binder may be 80 wt. %, the total weight of the polyethylene glycol in relation to the total weight of the organic binder or further organic binder may be 19.5 wt. %, and the total weight of the glycerol in relation to the total weight of the organic binder or further organic binder may be 0.5 wt. %.

In a further embodiment of the invention, the organic binder or further organic binder may be a mixture of ethylene glycol, alpha-terpineol, polyethylene glycol and glycerol. The inventors of the present invention found that a mixture of alpha-terpineol, ethylene glycol and polyethylene glycol, a mixture of alpha-terpineol, polyethylene glycol and glycerol, and a mixture of ethylene glycol, alpha-terpineol, polyethylene glycol and glycerol results in a composition allowing a relatively fast pre-drying without drying out the composition as specified according to the invention. This results in a relatively high stability of the composition, in particular a relatively high stability of the composition after pre-drying, and a relatively long work life of the composition as specified according to the invention, in particular of the composition as specified according to the invention after pre-drying, of up to one week. Furthermore, a sufficient tacking of the composition as specified according to the invention to the first surface and/or the second surface of the metal foil is enabled even after pre-drying of the coated metal foil and thus, no additional tacking agent needs to be provided in the composition as specified according to the invention.

The composition and/or the further composition as specified according to the invention may further comprise independently from each other a polar organic solvent or turpentine. The polar organic solvent may be a liquid polar organic solvent. The turpentine may be liquid turpentine. The polar organic solvent and the turpentine can each serve as a thinning agent. For the purpose of the present invention, a polar solvent is defined as a solvent having a dielectric constant of at least 7 measured at 20° C. A non-polar solvent is defined as a solvent having a dielectric constant of less than 7 at 20° C. Here, the dielectric constant of a given solvent is the ratio of the electric permeability of the solvent to the electric permeability of free space, i.e. a vacuum. The dielectric constant may be measured by an LCR meter or an impedance analyzer by methods known in the art. The polar solvent may be in particular an alcohol, acetone, or a mixture of an alcohol and acetone. The alcohol may be methanol, ethanol, propanol, isopropanol or a mixture of at least two of methanol, ethanol, propanol and isopropanol. The inventors of the present invention found that a composition or further composition further comprising a polar organic solvent or turpentine enables the composition or further composition to be coated on the first surface and/or the second surface of the metal foil in each case independently from each other in a relatively low thickness, in particular in a thickness of at most 10 μm, in particular of at most 5 μm, in particular of at most 1 μm.

A total content of solids in the composition or further composition as specified according to the invention may be at most 80 wt. %, in particular at most 75 wt. %, in particular at most 70 wt. %, in particular at most 65 wt. %, in particular at most 63 wt. %, in particular at most 60 wt. %, in particular at most 55 wt. %, in particular at most 50 wt. %, in particular at most 40 wt. %, in particular at most 30 wt. %, in particular at most 20 wt. %, in particular at most 10 wt. %. Thus, the total content of solids in the composition or further composition as specified according to the invention is considerably lower compared to silver sintering pastes having a total content of solids of about 90 wt. %. A relatively low total content of solids results in a relatively low viscosity of the composition as specified according to the invention. The viscosity of the composition as specified according to the invention may be in the range of 50 mPas to 400.000 mPas, in particular in the range of 100 mPas to 350.000 mPas, in particular in the range of 200 mPas to 200.000 mPas. The viscosity of the composition or further composition as specified according to the invention may be measured at room temperature, in particular at 20° C., using a standard viscosimeter, in particular a standard classical rotational viscosimeter, in particular the Thermo Scientific™ HAAKE™ Viscotester™ C. These rotational viscometers measure the resistance of the composition or further composition as specified according to the invention against a preset speed. The resulting torque or resistance is a measure for the viscosity of the composition or further composition as specified according to the invention. The higher the torque, the higher the viscosity. The low viscosity of the composition or further composition as specified according to the invention enables its easy processability and a good and its even spreadability on the first surface and/or the second surface of the metal foil.

The total weight of the flakes or further flakes, optionally coated with stearic acid, in relation to the total weight of the composition or further composition as specified according to the invention may be at most 80 wt. %, in particular at most 75 wt. %, in particular at most 70 wt. %, in particular at most 65 wt. %, in particular at most 63 wt. %, in particular at most 60 wt. %, in particular at most 55 wt. %, in particular at most 50 wt. %, in particular at most 45 wt. %, in particular at most 40 wt. %, in particular at most 30 wt. %, in particular at most 20 wt. %, in particular at most 10 wt. %. The remaining part of the composition or further composition may be formed by the organic binder or the further organic binder. This means that the total weight of the organic binder or further organic binder in relation to the total weight of the composition or further composition as specified according to the invention may be at least 20 wt. %, in particular at least 25 wt. %, in particular at least 30 wt. %, in particular at least 35 wt. %, in particular at least 37 wt. %, in particular at least 40 wt. %, in particular at least 45 wt. %, in particular at least 50 wt. %, in particular at least 55 wt. %, in particular at least 60 wt. %, in particular at least 70 wt. %, in particular at least 80 wt. %, in particular at least 90 wt. %. If the composition or further composition as specified according to the invention further comprises a polar organic solvent or turpentine, the remaining part of the composition or further composition may be formed by the polar organic solvent or the turpentine. The ratio of the total weight of the polar organic solvent to the total weight of the flakes together with the organic binder or to the total weight of the further flakes together with the organic binder or further organic binder may be at most 10:1, in particular at most 5:1, in particular at most 4:1, in particular at most 3:1, in particular at most 2:1, in particular at most 1:1, in particular at most 1:2, in particular at most 1:3, in particular at most 1:4. The ratio of the total weight of the turpentine to the total weight of the flakes together with the organic binder or to the total weight of the further flakes together with the organic binder or further organic binder may be at most 10:1, in particular at most 5:1, in particular at most 4:1, in particular at most 3:1, in particular at most 2:1, in particular at most 1:1, in particular at most 1:2, in particular at most 1:3, in particular at most 1:4. The inventors found that a relatively high ratio of the total weight of the polar organic solvent or the turpentine to the total weight of the flakes together with the organic binder in the composition as specified according to the invention or to the total weight of the further flakes together with the organic binder or further organic binder in the further composition as specified according to the invention enables the composition or further composition to be coated on the first surface and/or the second surface of the metal foil in each case independently from each other in a relatively low thickness, in particular in a thickness of at most 10 μm, in particular of at most 5 μm, in particular of at most 1 μm. The total weight of the flakes, the further flakes, the organic binder, the further organic binder, the optional stearic acid coated on the flakes or the further flakes and/or the optional polar organic solvent or the optional turpentine can each be determined by nuclear magnetic resonance spectroscopy, thermogravimetric analysis, mass spectrometry and infrared spectroscopy. The total weight of the flakes, the further flakes, the organic binder, the further organic binder, the optional stearic acid coated on the flakes or the further flakes and/or the optional polar organic solvent or the optional turpentine can be determined by weighing the flakes, the further flakes, the organic binder, the further organic binder, the optional stearic acid and/or the optional polar organic solvent or the optional turpentine before forming the composition or further composition as specified according to the invention.

An area of 10% to 100%, in particular 50% to 100%, in particular 55% to 95%, in particular 60% to 90%, in particular 65% to 85%, in particular 70% to 80%, of the total area of the first surface and/or of the total area of the second surface of the metal foil may be independently from each other coated with the composition as specified according to the invention. Alternatively, an area of 10% to 100%, in particular 50% to 100%, in particular 100%, of the total area of the first surface of the metal foil may be coated with the composition and a further area of 10% to 100%, in particular 50% to 100%, in particular 100%, of the total area of the second surface of the metal foil may be coated with the further composition. The area may be an area of 100% of the total area of the first surface and/or of the total area of the second surface. The composition may be coated on the first surface, in particular the area of the first surface, and/or the second surface, in particular the area of the second surface, of the metal foil in each case independently from each other in a thickness of at least 1 μm and at most 500 μm, in particular of at least 1 μm and at most 50 μm or of at least 5 μm and at most 400 μm, in particular of at least 10 μm and at most 300 μm, in particular of at least 20 μm and at most 250 μm, in particular of at least 50 μm and at most 200 μm, in particular of at least 75 μm and at most 150 μm, in particular of at least 100 μm and at most 125 μm. Alternatively, the composition may be coated on the first surface and the further composition may be coated on the second surface of the metal foil in each case independently from each other in a thickness of at least 1 μm and at most 500 μm, in particular of at least 1 μm and at most 50 μm. In case the composition or the further composition is coated in each case in a thickness of at least 1 μm and at most 50 μm, a sintered layer resulting from the composition or the further composition may have in each case a thickness of at least 200 nm and at the most 25 μm.

The coated metal foil may be arranged between the first solid substrate and the second solid substrate as a copper-containing interlayer connecting the first solid substrate with the second solid substrate or arranged on the solid substrate for connecting the solid substrate with the metal foil. An electrical and/or thermal conduct may be formed between the solid substrate and the metal foil or the first solid substrate and the metal foil by the composition coated on the metal foil after a sintering process. In case the solid substrate is only connected with the metal foil, the metal foil can dissipate heat from the solid substrate and act as a heat sink or it can dissipate heat to another heat sink. The solid substrate only connected with the metal foil can also be a precursor of a conductor plate.

A method for forming the flakes or further flakes comprises the steps of grinding and/or milling of copper particles or copper alloy particles. If flakes or further flakes coated with stearic acid shall be obtained, the grinding and/or milling of copper particles or copper alloy particles is performed in the presence of stearic acid. The grinding and/or milling can be performed for example in a ball mill. The flakes or further flakes are obtained during grinding and/or milling of the copper particles or copper alloy particles. The flakes or further flakes coated with stearic acid are obtained during grinding and/or milling of the copper particles or copper alloy particles in the presence of stearic acid. During the grinding and/or the milling of the copper particles or copper alloy particles in the presence of stearic acid, the total weight of the stearic acid in relation to the total weight of the copper particles or the copper alloy particles may be relatively low. Furthermore, the total number of individual grinding and/or milling steps of the copper particles or copper alloy particles in the presence of stearic acid may be relatively low. In particular, the total number of individual grinding and/or milling steps of the copper particles or copper alloy particles in the presence of stearic acid may be at most three, in particular at most two, in particular at most one, respectively. This enables the obtaining of the flakes or further flakes coated with stearic acid, wherein the total weight of the stearic acid in relation to the total weight of the flakes or further flakes coated with stearic acid is at most 1.5 wt. %. The total weight of the stearic acid coated on the flakes or further flakes in relation to the total weight of the flakes or further flakes coated with stearic acid can be determined by nuclear magnetic resonance spectroscopy, thermogravimetric analysis, Rutherford backscattering spectrometry, mass spectrometry, infrared spectroscopy, Raman spectroscopy and X-ray spectroscopy in combination with nuclear magnetic resonance spectroscopy.

A method for forming the composition as specified according to the invention comprises the steps of providing the organic binder, the flakes, optionally coated with stearic acid, and optionally the polar organic solvent or optionally the turpentine and mixing the organic binder, the flakes, optionally coated with stearic acid, and optionally the polar organic solvent or optionally the turpentine for obtaining the composition as specified according to the invention. A method for forming the further composition as specified according to the invention comprises the steps of providing the organic binder or the further organic binder, the flakes or the further flakes, optionally coated with stearic acid, and optionally the polar organic solvent or optionally the turpentine and mixing the organic binder or the further organic binder, the flakes or the further flakes, optionally coated with stearic acid, and optionally the polar organic solvent or optionally the turpentine for obtaining the further composition as specified according to the invention. The further composition may differ from the composition not only by the individual components, but also, in the case of identical components, by different weight ratios of the components to each other.

The invention also concerns a method for producing the coated metal foil according to the invention comprising the steps of a) providing
   - the metal foil of copper or of the first copper alloy or of a copper plated nickel-iron alloy, wherein the metal foil has a first surface and a second surface as specified above,
   - the flakes and optionally the further flakes of copper or of the first copper alloy or of a second copper alloy as specified above, wherein the flakes and the further flakes comprise internal pores,
   - the organic binder and optionally the further organic binder as specified above, and optionally the polar organic solvent as specified above or optionally the turpentine as specified above, b) mixing the flakes, the organic binder, and optionally the polar organic solvent or optionally the turpentine for obtaining a composition and optionally the flakes or the further flakes and the organic binder or the further organic binder and optionally the polar organic solvent or optionally the turpentine for obtaining a further composition, and c) applying the composition obtained in step b) to the first surface and/or the second surface of the metal foil or applying the composition obtained in step b) to the first surface of the metal foil and the further composition obtained in step b) to the second surface of the metal foil for obtaining the coated metal foil.

Thus, the coated metal foil according to the invention can be produced by the above method. The composition obtained in step b) may be the composition as specified according to the invention and the further composition obtained in step b) may be the further composition as specified according to the invention. Applying the composition obtained in step b) to the first surface and/or the second surface of the metal foil or applying the composition obtained in step b) to the first surface of the metal foil and the further composition obtained in step b) to the second surface of the metal foil may be performed in each case by coating, in particular doctor blade coating or spray coating, by dip coating, by printing, in particular stencil printing, inkjet printing, aerosol jet printing or screen-printing, by direct writing or by material dispensing.

The composition and/or the further composition may be applied independently from each other to 10% to 100%, in particular 50% to 100%, in particular 55% to 95%, in particular 60% to 90%, in particular 65% to 85%, in particular 70% to 80%, of an area of the first surface and/or of an area of the second surface of the metal foil. The area may be the total area of the first surface and/or the total area of the second surface. The composition may be applied to the first surface, in particular the area of the first surface, and the composition or the further composition may be applied to the second surface, in particular the area of the second surface, of the metal foil in each case independently from each other in a thickness of at least 1 μm and at most 500 μm, in particular of at least 5 μm and at most 400 μm, in particular of at least 10 μm and at most 300 μm, in particular of at least 20 μm and at most 250 μm, in particular of at least 50 μm and at most 200 μm, in particular of at least 75 μm and at most 150 μm, in particular of at least 100 μm and at most 125 μm.

Before step c), the metal foil may be heated to a first pre-treatment temperature in the range of 170° C. to 220° C. for at least 1 minute, in particular at least 2 minutes, in particular at least 3 minutes, and at most 2 hours, in particular at most 1 hour, in particular at most 30 minutes, in particular at most 20 minutes, in particular at most 10 minutes, in particular at most 8 minutes, in particular at most 5 minutes. The inventors of the present invention found that heating the metal foil to the first pre-treatment temperature results in the removal of organic residues present on the metal foil as a result of its standard production process, such as rolling. Removal of organic residues from the first surface and/or the second surface enables an efficient sintering and a relatively high wettability of the first surface and/or the second surface. After heating the metal foil to the first pre-treatment temperature, the metal foil may be cooled to a second pre-treatment temperature in the range of 15° C. to 40° C., in particular 20° C. to 30° C. Cooling may be performed by active cooling but usually is passive cooling, i.e. by letting the coated metal foil cool down to the second pre-treatment temperature which usually is ambient temperature. Optionally, the heating to the first pre-treatment temperature and/or the cooling to the second pre-treatment temperature may be performed in a reducing atmosphere, in an inert atmosphere and/or in a vacuum. This avoids oxidation of the first surface and/or the second surface of the metal foil during the heating to first pre-treatment temperature and/or the cooling to the second pre-treatment temperature. The vacuum may be a relatively high vacuum of at least 10 mbar, in particular at least 1 mbar, in particular at least 0.3 mbar.

After applying the composition and/or further composition as specified according to the invention to the first surface and/or the second surface of the metal foil according to step c), an optional step d) of heating the composition on the first surface and/or the second surface of the metal foil, or the first surface and/or the second surface together with the composition or together with the composition and the further composition to a pre-drying temperature in the range of 100° C. to 160° C., in particular in the range of 110° C. to 150° C., in particular in the range of 120° C. to 140° C., in particular in the range of 125° C. to 130° C., may be performed.

Alternatively, it is also possible that after the composition obtained in step b) was applied to the first surface, the metal foil is heated to a pre-drying temperature in the range of 100° C. to 160° C., in particular in the range of 110° C. to 150° C., in particular in the range of 120° C. to 140° C., in particular in the range of 125° C. to 130° C., for at least 1 minute and at most 30 minutes followed by a cooling step, application of the composition or the further composition obtained in step b) to the second surface and heating the metal foil to the pre-drying temperature in the range of 100° C. to 160° C., in particular in the range of 110° C. to 150° C., in particular in the range of 120° C. to 140° C., in particular in the range of 125° C. to 130° C., for at least 1 minute and at most 30 minutes.

The pre-drying temperature may be maintained for at least 30 seconds, in particular at least 1 minute, in particular at least 2 minutes, in particular at least 3 minutes and for at most 30 minutes, in particular at most 20 minutes, in particular at most 10 minutes, in particular at most 8 minutes, in particular at most 6 minutes, in particular at most 5 minutes, in particular at most 4 minutes. Heating to the pre-drying temperature and maintaining the pre-drying temperature according to optional step d) may be performed in a reducing atmosphere, in an inert atmosphere and/or in a vacuum.

During optional step d), at least 70 wt. %, in particular at least 75 wt. %, in particular at least 80 wt. %, in particular at least 85 wt. %, in particular at least 90 wt. %, in particular at least 95 wt. %, in particular at least 99 wt. %, of the initial weight of the organic binder and/or further organic binder and/or the optional polar organic solvent or the optional turpentine may be evaporated. Evaporation refers to the conversion of the liquid organic binder and/or further organic binder and/or the optional liquid polar organic solvent or the optional turpentine to its vapor below the boiling temperature of the organic binder and/or further organic binder and/or below the boiling temperature of the optional polar organic solvent or the optional turpentine, respectively. If step d) is performed in a vacuum, the evaporation of the organic binder and/or further organic binder and/or the optional polar organic solvent or the optional turpentine is further increased. The initial weight of the organic binder and/or further organic binder can be determined by weighing of the organic binder and/or further organic binder and/or the optional polar organic solvent or the optional turpentine before providing/preparing the composition and/or further composition as specified according to the invention and/or by mass spectrometry or thermal gravimetric analysis before and after the heating according to step d). Even though the optional polar organic solvent or the optional turpentine may be completely evaporated during step d), a residual organic binder and/or further organic binder, in particular at most 30 wt. %, in particular at most 25 wt. %, in particular at most 20 wt. %, in particular at most 15 wt. %, in particular at most 10 wt. %, in particular at most 5 wt. %, in particular at most 1 wt. %, of the initial weight of the organic binder and/or further organic binder may remain in the coated metal foil, in particular in the composition and/or further composition coated independently from each other on the first surface and/or second surface of the metal foil. The residual organic binder and/or further organic binder in the coated metal foil enables a good adhesion of the flakes and/or further flakes to the first surface and/or the second surface of the metal foil. Furthermore, the residual organic binder and/or further organic binder has a reducing effect on the coated metal foil during sintering of the coated metal foil and may provide a tack to place the coated foil on the surface and/or surfaces of a solid substrate to be bonded firmly. The weight of the residual organic binder and/or further organic binder in the coated metal foil can be determined by weighing of the coated metal foil during or before and after the heating according to optional step d) and/or by mass spectrometry or thermal gravimetric analysis.

After the method according to the invention, in particular after step c), or, optionally, after step d), the coated metal foil produced by the method according to the invention may be applied in a method for forming a copper-containing interconnection layer between two solid substrates or between a solid substrate and the metal foil comprising the steps of e) providing the coated metal foil according to the invention produced by the method according to the invention, providing the solid substrate or providing a first solid substrate and providing a second solid substrate, f) applying the coated metal foil according to the invention to the solid substrate or the first solid substrate, g) placing the second solid substrate on the coated metal foil according to the invention in case the copper-containing interconnection layer shall be formed between two solid substrates, h) applying a bonding pressure to press the solid substrate and the coated metal foil or the first solid substrate and the second solid substrate against one another, wherein the bonding pressure may be at least 100 kPa, in particular 1 MPa, in particular at least 2.5 MPa, in particular at least 5 MPa, in particular at least 7.5 MPa, in particular at least 10 MPa, and at most 40 MPa, in particular at most 35 MPa, in particular at most 30 MPa, in particular at most 25 MPa, in particular at most 20 MPa, in particular at most 15 MPa, i) heating the coated metal foil or the solid substrate or the first solid substrate and/or the second solid substrate together with the coated metal foil to a sintering temperature in the range of 200° C. to 300° C., in particular in the range of 205° C. to 275° C., in particular in the range of 210° C. to 270° C., in particular in the range of 215° C. to 265° C., in particular in the range of 220° C. to 260° C., in particular in the range of 225° C. to 255° C., in particular in the range of 230° C. to 250° C., in particular in the range of 235° C. to 245° C., and maintaining the sintering temperature and the bonding pressure until a copper-containing interlayer between the solid substrate and the metal foil or the first solid substrate and the second solid substrate is formed.

Applying the coated metal foil according to the invention to the solid substrate or the first solid substrate and/or placing the second solid substrate on the coated metal foil may be performed manually, by transfer, in particular by vacuum-mediated foil transfer or by vacuum-mediated substrate transfer, or by means of a pick-and-place machine.

The sintering temperature and the bonding pressure may be maintained for at least 1 second, in particular for at least 5 seconds, in particular for at least 30 seconds, in particular for at least 1 minute, in particular for at least 3 minutes, in particular for at least 4 minutes, and for at most 30 minutes, in particular for at most 15 minutes, in particular for at most 10 minutes, in particular for at most 8 minutes, in particular for at most 5 minutes.

The method for forming a copper-containing interlayer between two solid substrates or between the solid substrate and the metal foil may further comprise a step j) of cooling the copper-containing interlayer obtained in step i) between the first solid substrate and the second solid substrate or between the solid substrate and the metal foil or the solid substrate or the first solid substrate and/or the second solid substrate together with the copper-containing interlayer obtained in step i) to a cooling temperature in the range of 15° C. to 40° C., in particular in the range of 20° C. to 30° C. The cooling temperature may be ambient temperature. Cooling according to step j) may be performed by active cooling but usually is passive cooling, i.e. by letting the copper-containing interlayer or the solid substrate or the first solid substrate and/or the second solid substrate together with the copper-containing interlayer cool down to the cooling temperature which usually is ambient temperature.

At least step c), in particular at least steps b) and c), in particular at least steps a) to c), of the method according to the invention may be performed in a reducing atmosphere, in an inert atmosphere and/or in a vacuum. Optionally, step d) of the method according to the invention may be performed in a reducing atmosphere, in an inert atmosphere and/or in a vacuum. At least step i), in particular at least steps i) and h), in particular at least steps g) to i), in particular at least steps f) to i), in particular steps e) to i), of the method for forming a copper-containing interlayer between two solid substrates may be performed in a in a reducing atmosphere, in an inert atmosphere and/or in a vacuum. Optionally, step j) may be performed in a reducing atmosphere, in an inert atmosphere and/or in a vacuum.

The reducing atmosphere may in each case independently from each other be provided by means of a mixture of evaporated formic acid and nitrogen gas or by means of a gas mixture of hydrogen and an inert gas. The gas mixture of hydrogen and the inert gas may be a gas mixture of nitrogen and hydrogen or a gas mixture of argon and hydrogen. The inert atmosphere may in each case independently from each other be provided by means of an inert gas. The inert gas may be contained in an inert gas mixture. The inert gas may be nitrogen gas, carbon dioxide gas, helium gas, neon gas or argon gas. The inert gas mixture may be a mixture of at least two of nitrogen gas, carbon dioxide gas, helium gas, neon gas and argon gas.

The inventors of the present invention found that the coated metal foil according to the invention provides a relatively good conductivity of the copper bond after sintering due to relatively low oxide impurities. The oxide impurities are so low that it is not necessary to apply a reducing atmosphere during sintering.

The pressure of the vacuum may in each case independently from each other be a pressure in the range of 0.1 mbar to 10 mbar, in particular in the range of 0.5 mbar to 5 mbar, in particular in the range of 1 mbar to 3 mbar. The inventors of the present invention found that sintering in a vacuum results in a further evaporation of the organic binder and/or further organic binder and/or the optional polar organic solvent or the optional turpentine at a relatively low temperature due to a vacuum-induced reduction of the boiling point of the organic binder and/or further organic binder and/or the optional polar organic solvent or the optional turpentine. The further evaporation of the organic binder and/or further organic binder and/or the optional polar organic solvent or the optional turpentine further improves the sintering efficiency of the coated metal foil according to the invention and contributes to sintering at a relatively low sintering temperature.

During step e), at least 70 wt. %, in particular at least 75 wt. %, in particular at least 80 wt. %, in particular at least 85 wt. %, in particular at least 90 wt. %, in particular at least 95 wt. %, in particular at least 99 wt. %, in particular 100 wt. % of the initial weight of the organic binder and/or further organic binder, in particular the residual organic binder and/or residual further organic binder, and/or the optional polar organic solvent or the optional turpentine may be evaporated. If optional step d) has been performed prior to step e), the residual organic binder and/or residual further organic binder may be evaporated completely during step e). The initial weight of the organic binder and/or further organic binder can be determined by weighing of the organic binder and/or further organic binder before providing/preparing the composition and/or further composition as specified according to the invention. The evaporation of the organic binder and/or further organic binder, in particular the residual organic binder and/or the residual further organic binder, can be determined either by weighing of the first solid substrate and/or the second solid substrate together with the coated metal foil according to the invention during or before and after the heating according to step e) and/or by mass spectrometry or thermal gravimetric analysis.

The first solid substrate may be made of or consist of a metal or a metal oxide and the second solid substrate may be made of or consist of the metal, a further metal, the metal oxide, a further metal oxide or a surface mount device component. The metal and/or the further metal may be in the form of a further foil. The metal or the further metal may be gold, silver, nickel, palladium, copper, pre-treated copper or tin. The metal oxide or the further metal oxide may be aluminum oxide. The surface mount device component may be a capacitor, a chip resistor, a crystal oscillator, a diode, a fuse, an inductor, an integrated circuit, an LED, a network resistor, a transformer, a transistor, a silicon carbide (SiC) device or a gallium nitride (GaN) device. The diode may be a silicon diode. The transistor may be a metal-oxide semiconductor field-effect transistor (MOSFET). The inventors of the present invention found that the organic binder and/or further organic binder, in particular the residual organic binder and/or residual further organic binder, can also reduce oxides on the first and/or the second solid substrate. Therefore, the coated metal foil according to the invention enables sintering on copper, silver and/or nickel substrates even if these substrates are covered by an oxide layer, in particular an oxide layer of $Cu_2O$.

The pre-treated copper may be pre-treated for example by coating a copper substrate with an organic surface protection (OSP) layer, wherein the OSP layer protects the copper against oxidation and is dissolved during the soldering process. Alternatively, other methods, e.g. sol-gel application or CVD, can be used to coat the copper substrate with a protective layer in order to protect the copper against oxidation.

The invention further concerns the use of the coated metal foil according to the invention for forming a copper-containing interlayer/interconnect layer between two surfaces of solid substrates, i.e. between a surface of a first solid substrate and a further surface of a second solid substrate or between a surface of a solid substrate and the metal foil, in particular for die-attach bonding, in microelectronics packaging, in electric vehicle technologies, in hybrid electric vehicle technologies, in high power electronics packaging, in thick film technology, in large area bonding and/or in battery applications. In particular, the invention concerns the use of the coated metal foil according to the invention for die-attach bonding. The invention further concerns the use of the coated metal foil according to the invention for forming a conductive path on a solid substrate. The conductive path on the solid substrate may be an electrically and/or a thermally conductive path on the solid substrate. The invention further concerns the use of the coated metal foil according to the invention for substrate attachment. The microelectronics packaging may be WBG semiconductor packaging. The high power electronics packaging may be high power light emitting diode packaging. The inventors of the present invention found that the use of the coated metal foil according to the invention for forming a copper-containing interlayer/interconnect layer between two solid substrates or for forming a conductive path on a solid substrate enables a relatively low thermal load of the solid substrate(s) and any electronic component, in particular the surface mount device component as specified above, on the solid substrate(s) when forming the interconnection layer or conductive path. This is due to the relatively low sintering temperature required to sinter the coated metal foil according to the invention.

If the coated metal foil according to the invention is used for forming an electrically and/or thermally conductive path on a solid substrate, the solid substrate may be any substrate defined above as first or second substrate or solid substrate as far as it is not an electrically conductive first or second substrate. If the coated metal foil according to the invention is used for substrate attachment, the substrate may be any substrate defined above as first or second substrate, an aluminum substrate, in particular a metallized aluminum substrate, in particular a copper-metallized aluminum substrate, a ceramic substrate, in particular a metallized ceramic substrate, in particular a copper-metallized ceramic substrate, a directed bonded copper substrate or a polymer substrate, in particular a polyimide substrate.

All features indicated in the specification are to be understood as features applicable to all embodiments of the invention. This means, for example, that a feature indicated for the coated metal foil according to the invention can also be applied to the composition as specified according to the invention, the method for producing the coated metal foil according to the invention, the method for forming a copper-containing interlayer between the first solid substrate and the second solid substrate according to the invention, and/or the use according to the invention, and vice versa. Furthermore, as far as not otherwise specified, the term "average" always means "arithmetic average" and the term "mean" always means "arithmetic mean". The abbreviation "wt. %" means "percent by weight". The abbreviation "v/v" means "volume by volume".

The invention will be explained in more detail with reference to the following figures and embodiments.

FIG. 1 shows an SEM image of a cross-section of copper flakes comprising internal pores, FIG. 2 shows an SEM image of a cross-section of copper flakes having a multi-layer lamellar structure, FIGS. 3*a* and 3*b* show scanning transmission electron microscopy images of a multi-layer lamellar structure, FIG. 4 shows an SEM image of a foil according to the invention, FIG. 5 shows an SEM image of the foil of FIG. 4 in another magnification, FIG. 6 shows an SEM image of the foil of FIG. 4 in another magnification, FIG. 7 shows an SEM image of another foil according to the invention coated with a thin layer of flakes, FIG. 8 shows an SEM image of the foil of FIG. 7 in another magnification, FIG. 9 shows a focused ion beam scanning electron microscopy (FIB-SEM) image of another foil according to the invention coated with a thin layer of flakes, FIG. 10 shows a cut-out of the image of FIG. 9 in another magnification, FIG. 11 shows an FIB-SEM image of another foil according to the invention coated with a thick layer of flakes, FIG. 12 shows an SEM image of a cross-section of an interconnect between a chip and a copper substrate which interconnect resulted from sintering of a coated copper foil according to the invention, FIG. 13 shows an SEM image of a cross-section of an interconnect between a copper foil and a copper substrate which Interconnect resulted from sintering of a coated copper foil according to the invention and FIG. 14 shows an SEM image of a cross-section of an interconnect between two ceramic substrates resulting from sintering of the coated metal foil.

Example 1: Mean Intraparticle Pore Density and Mean Interparticle Cavity Density of the Flakes of Copper The composition as specified according to the invention comprises flakes comprising internal pores. Exemplarily, these flakes comprising internal pores can be purchased as Cubrotec 8001 copper flakes, which are offered by the company Carl Schlenk SE, Germany. A cross-section of the Cubrotec 8001 copper flakes is shown in FIG. 1. In FIG. 1, a number of internal pores of the copper flakes are exemplarily shown by filled arrows. Spaces between the flakes resulting in interparticle cavities after sintering are exemplarily shown by unfilled arrows.

As can be seen in FIG. 1, the Cubrotec 8001 copper flakes have a relatively high number of internal pores and a relatively high mean intraparticle pore density. The Cubrotec 8001 copper flakes have a mean intraparticle pore density of 30 internal pores/$\mu m^2$. The space between the Cubrotec 8001 copper flakes is 40%.

Example 2: Flakes of Copper or a Copper Alloy Having a Multi-Layer Lamellar Structure If the flakes are Cubrotec 8001 copper flakes, the flakes have a multi-layer lamellar structure. Cubrotec 8000 flakes do only have a lamellar but not a multi-layer lamellar structure. A cross-section of the Cubrotec 8001 copper flakes showing the multi-layer lamellar structure of the copper flakes is shown in FIG. 2. In FIGS. 2, the stack-like multi-layer lamellar structure is shown in white dotted boxes for three copper flakes, exemplarily. The multi-layer lamellar structures each consist of varying numbers of lamellas ranging from 2 to 20 lamellas. Furthermore, the multilayer lamellar structures have a varying total thickness in the range of 20 nm to 400 nm.

In FIGS. 3*a* and 3*b*, scanning transmission electron microscopy (STEM) images of a multi-layer lamellar structure exemplarily consisting of ten lamellas is shown. In FIG. 3*a*, the lamellar boundaries between the lamellas (lamellas 1 to 10) in the stack-like multi-layer lamellar structure are exemplarily shown by black dotted lines. In this regard, for example lamella 1 is in contact with lamella 2 by one lamellar boundary. However, lamella 2 is in contact with both lamella 1 and lamella 3 by one lamellar boundary each, etc. This results in the stack-like multi-layer lamellar structure consisting of lamellas in contact with each other. Furthermore, in FIG. 3*b*, the nanocrystalline structure of the copper forming the lamellas in the stack-like multi-layer lamellar structure is shown.

Example 3: Compositions

The following compositions were tested:

In each of the compositions No. 3, No. 5 and No. 7 to No. 12, the total weight of the copper flakes coated with stearic acid in relation to the total weight of the composition is in the range of 60 wt. % to 76 wt. %. The total weight of the copper flakes coated with stearic acid includes the total weight of the stearic acid coated on the copper flakes and the total weight of the copper flakes. For example, in composition No. 3, 60 wt. % copper flakes coated with stearic acid comprises 58.5 wt. % copper flakes and 1.5 wt. % stearic acid coated on the copper flakes. Thus, the total content of solids in composition No. 3 is 58.5 wt. %. Furthermore, the organic binder in composition No. 3 is a mixture of ethylene glycol and alpha-terpineol. In this regard, the total weight of the ethylene glycol in relation to the total weight of the composition is 16 wt. % and the total weight of the alpha-terpineol to the total weight of the composition is 24 wt. %. Thus, composition No. 3 comprises a total weight of organic binder in relation to the total weight of the composition of 40 wt. %.

Example 4: Production of the Composition

In the following, the formulation of compositions No. 1 and No. 5 are exemplarily shown. The formulation of composition No. 1 comprises the following steps:

TABLE 1

| Compositions | | | | | | | | | |
|---|---|---|---|---|---|---|---|---|---|
| | Composition (wt. %) | | | | | | | | |
| | | | Total weight of the stearic acid in relation to the total weight of the flakes coated | Organic binder | | | | Polar organic | Total content of |
| Composition No. | (Coated) copper flakes | Stearic acid coating | with stearic acid | Ethylene glycol | Alpha-terpineol | Polyethylene glycol 600 | Glycerol | solvent or turpentine | solids in composition (wt. %) |
| 1 | 63 | – | — | 37 | — | — | — | — | 63 |
| 2 | 32.5 | – | — | 18.5 | — | — | — | 50 | |
| 3 | 60 | + | 1.5 | 16 | 24 | — | — | — | 58.5 |
| 4 | 30 | + | 1.5 | 8 | 12 | — | — | 50 | 30 |
| 5 | 60 | + | 1.5 | 15.5 | 24 | 0.5 | — | — | 58.5 |
| 6 | 30 | + | 1.5 | 7.75 | 12 | 0.25 | — | 50 | 30 |
| 7 | 60 | + | 1.5 | 15 | 24 | 0.5 | 0.5 | — | 58.5 |
| 8 | 75 | + | 0.5 | 10 | 15 | — | — | — | 74.5 |
| 9 | 75 | + | 0.5 | 12 | 12.5 | 0.5 | — | — | 74.5 |
| 10 | 75 | + | 0.5 | 12 | 12 | 0.5 | 0.5 | — | 74.5 |
| 11 | 62.5 | + | 1.5 | — | 30 | 7.5 | — | — | 61 |
| 12 | 76 | + | 0.5 | — | 19.2 | 4.8 | — | — | 75.5 |

Table 1 shows different compositions that can be coated on the first surface and/or the second surface of the foil of copper or the copper alloy. In each of the compositions No. 1 to No. 12, Cubrotec 8001 copper particles were exemplarily used. As can be seen in Table 1, the compositions No. 1 and No. 2 do not contain copper flakes coated with stearic acid. The compositions No. 3 to No. 12 contain copper flakes coated with stearic acid. In composition No. 2, isopropanol was exemplarily used as optional polar organic solvent. In composition No. 4, acetone was exemplarily used as optional polar organic solvent. In composition No. 6, optional turpentine was used.

In a standard paste mixing jar, commercially available for speed mixers and planetary mixers, 63 g of copper flakes are added. Subsequently, 37 g of ethylene glycol as exemplary organic binder are added to the copper flakes. The mixture is mixed for 4 min at 1000 rpm followed by 5 min at 500 rpm in a planetary rotary mixture. Alternatively, the mixture can also be mixed in a speed mixer at 1500 rpm for 30 s.

The formulation of composition No. 5 comprises the following steps:

15.5 g of ethylene glycol, 24 g of alpha-terpineol and 0.5 g of PEG 600 are mixed in a beaker with magnetic stirrer for 3 min at 500 rpm. Thus, the organic binder is obtained. In a planetary rotary mixer, 60 g of stearic acid-coated copper flakes, i.e. flakes with maximal 1.5 wt % stearic acid coating on them, are added. Subsequently, the above organic binder is added to the coated copper flakes and mixed for 4 min at 1000 rpm and for 5 min at 500 rpm in a planetary rotary mixer.

Example 5: Pre-Treatment of the Copper Foil

A copper foil having a thickness of 10 μm was purchased from the company Schlenk Metallfolien GmbH & Co. KG. Since the foil was manufactured by a traditional rolling process, oily residues were on its surface. For removing the oily residues the foil was pre-treated as follows:

The foil was cut into pieces of 50 mm×50 mm. Each piece was placed on the heat plate of the reflow oven RSS-160-S of the company UniTemp GmbH, Luitpoldstr. 6, D-85276 Pfaffenhofen, Germany at 25° C. Then the oven was closed and a vacuum of 1 mbar was applied followed by heating at 60K/s from 25° C. to 180° C. and maintaining vacuum and temperature for 30 min. Finally, the oven with the foil was cooled to 25° C. at 30K/min under the vacuum. Finally, the vacuum was released by introducing nitrogen into the oven before the foil was removed. After these steps, the piece of the foil was free of organic oily residues on both sides and could be used for spray coating as outlined below.

Example 6: Spray Coating of the Pre-Treated Copper Foil

Each of compositions Nos. 2 to 7, as indicated in examples 3 and 4, was independently from each other applied to a first surface and/or a second surface of separate pre-treated copper foils by spray coating. Each of compositions Nos. 1 and 8 to 12 was independently from each other applied by a manual coating to a first surface and/or a second surface of separate pre-treated copper foils as follows:

Spray coating was performed using a SM300OMEGAX-3A-SS, SHOTMASTER 300 OMEGAX of the company MUSASHI ENGINEERING EUROPE GMBH, Marcel-Breuer-Str. 15, 80807 München, Germany. The following spray coating parameters were applied:

Nozzle opening 100-120 μm (screw valve mechanism)

Air pressure for

Cartridge inlet—0.3-0.4 MPa

Chamber—0.3 MPa

Nozzle—0.4-0.5 MPa

The Spray coating was performed by printing 30 mm lines with a pitch of 0.5 mm at a coating speed of 200 mm/s.

Though spray coating is exemplarily shown as application method, other application methods, such as aerosol jet printing, screen printing or material dispensing were also performed in other examples in order to apply the compositions to the first surface and/or the second surface of the copper foil.

The manual coating was performed with a metal squeeze for compositions Nos. 1 and 8 to 12. This is due to the higher viscosity of these formulations due to the absence of the polar organic solvent, not allowing for a spray coating process. In this case, the formulation is applied on the edge of the foil and manually spread on the entire surface of the foil through a single stroke application with a hand held metal squeeze to obtain a uniform layer on the foil.

Example 7: Preparation of the Coated Copper Foil by Sintering

After completion of spray coating and manual coating, the foils were sintered by first performing a pre-drying step and then a sintering step as follows:

Pre-drying was performed in the hot air steriliser SN30 of the company Memmert GmbH+Co. KG, Aeussere Rittersbacher Strasse 38, 91126 Schwabach, Germany. For this purpose the sterilizer was preset to 120° C. and once the temperature was reached, the coated foils were placed in the oven while running at 100% fan speed for 5 min. Then the door of the steriliser was opened and the foils were removed from the oven at 120° C. and allowed to cool outside in air to room temperature. Therefore, a hot-in/hot-out process was employed to pre-dry the foils. This pre-drying resulted in evaporation of the organic binder. However, residual organic binder remains on each coated copper foil, which enables an adhesion of the flakes to the first surface and/or the second surface of the copper foil, respectively. Following this step sintering was performed as detailed below.

For obtaining the foils shown in FIGS. 4 to 11 the sintering was performed under pressureless conditions in the reflow oven RSS-160-S of the company UniTemp GmbH under nitrogen for 30 min at 250° C. as follows:

The pre-dried foils were placed on the heat plate of the reflow oven at 25° C. and the oven was closed. A vacuum of 1 mbar was applied at 25° C. Then nitrogen is flowed into the chamber at 25° C. for 1 min. Then the oven is ramped up to 250° C. at 30K/s under nitrogen and then maintained under nitrogen at 250° C. for 30 min before cooling down under nitrogen at a rate of 30K/s to 25° C. followed by retrieving the sintered foils.

The foils were examined by SEM and FIB-SEM. The results are shown in FIGS. 4 to 11.

In FIG. 4 the flakes show their potential for a uniform coverage of an area of the copper foil. In FIG. 5 the arrows sintered connections in the form of sintering necks between the flakes. This demonstrates that the flakes show very good sintering capability even under pressureless conditions at 250° C. for 30 min in an inert atmosphere.

Figure 1:
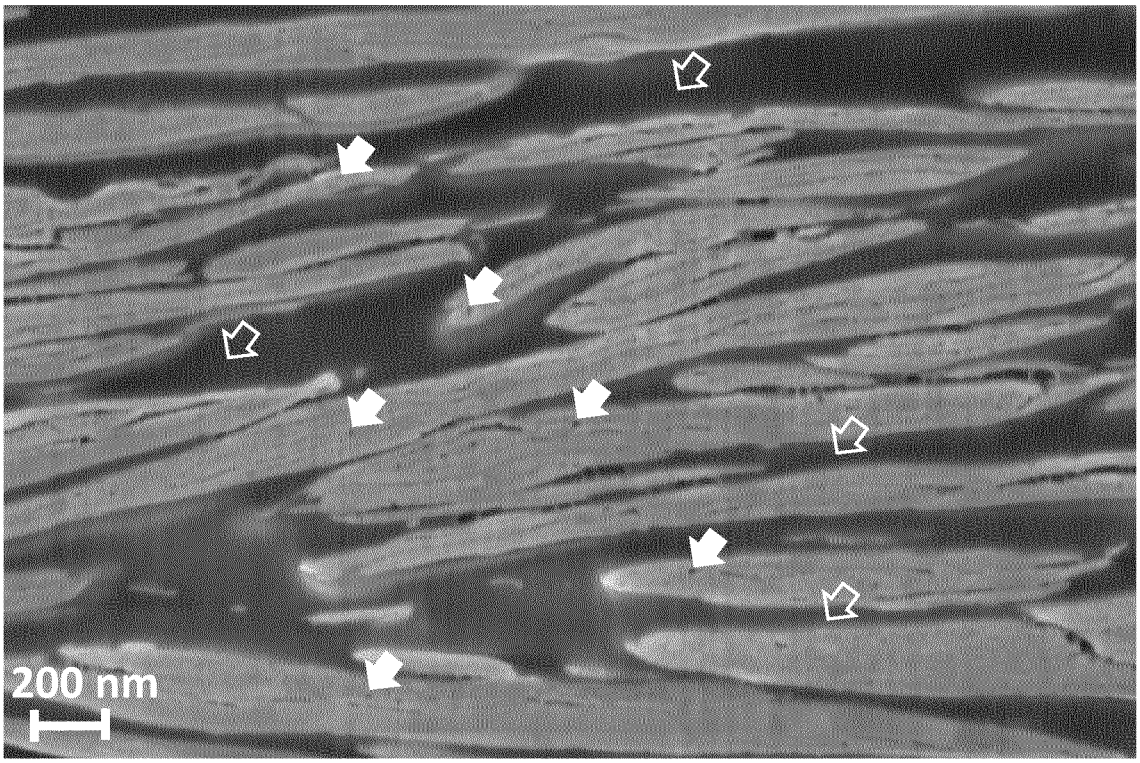
Figure 2:
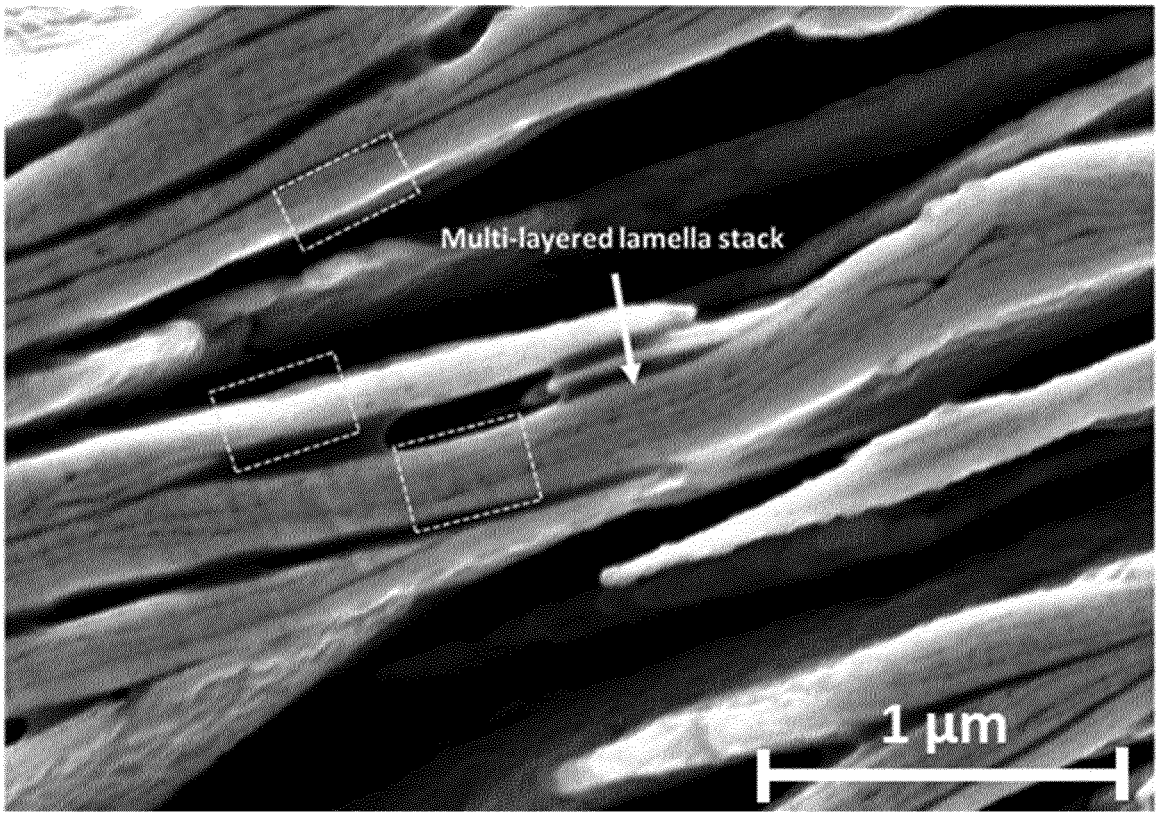
Figure 3:
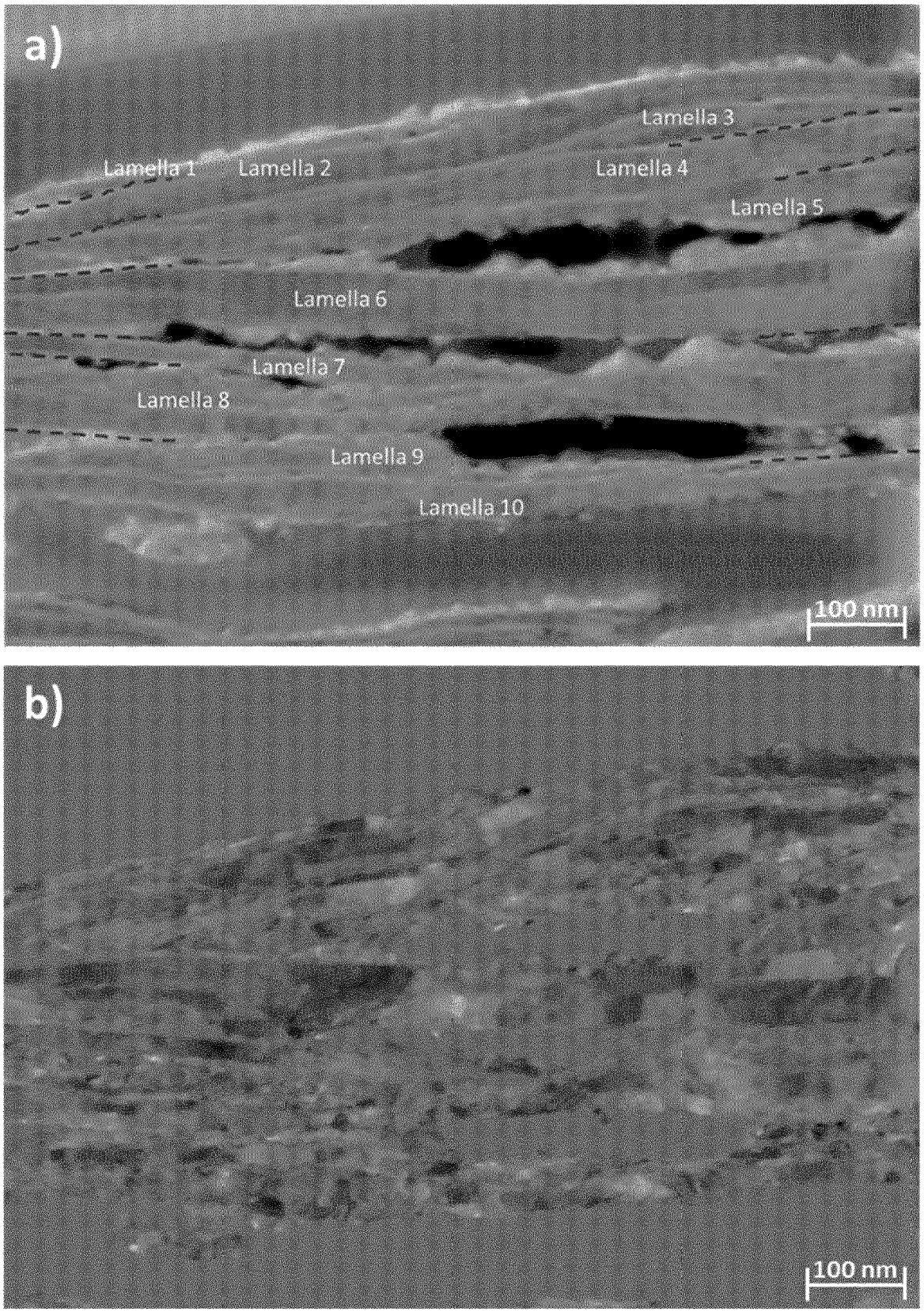
Figure 4:
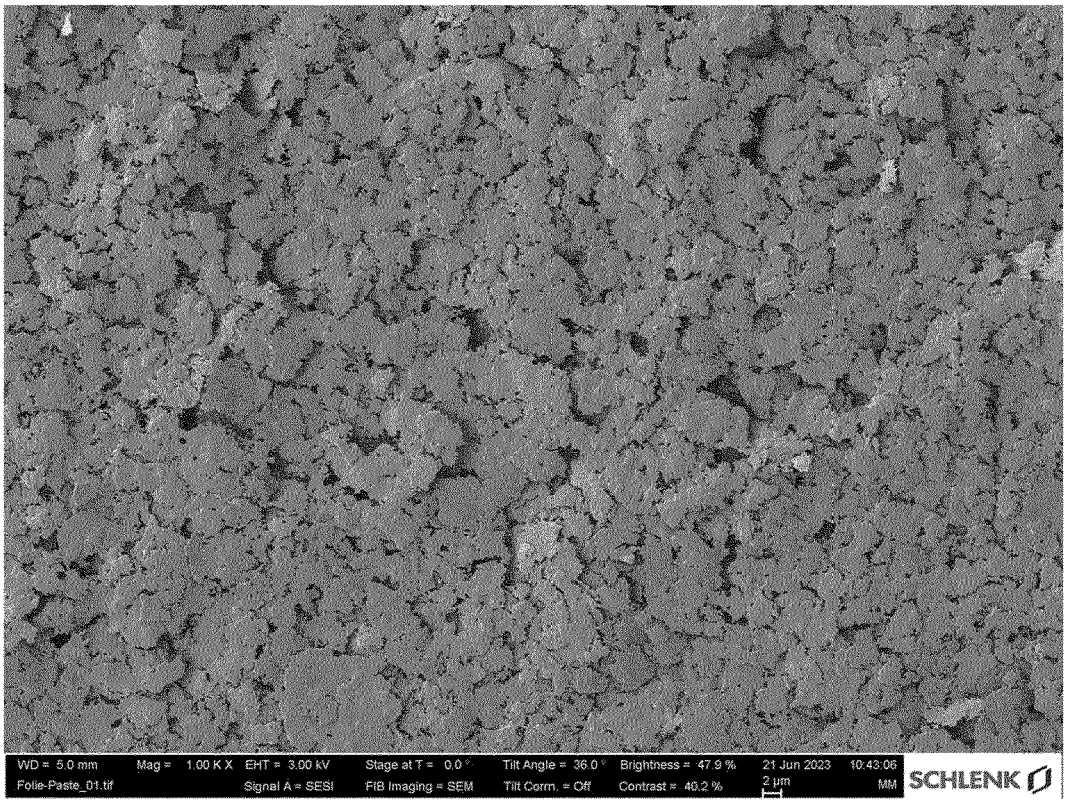
Figure 5:
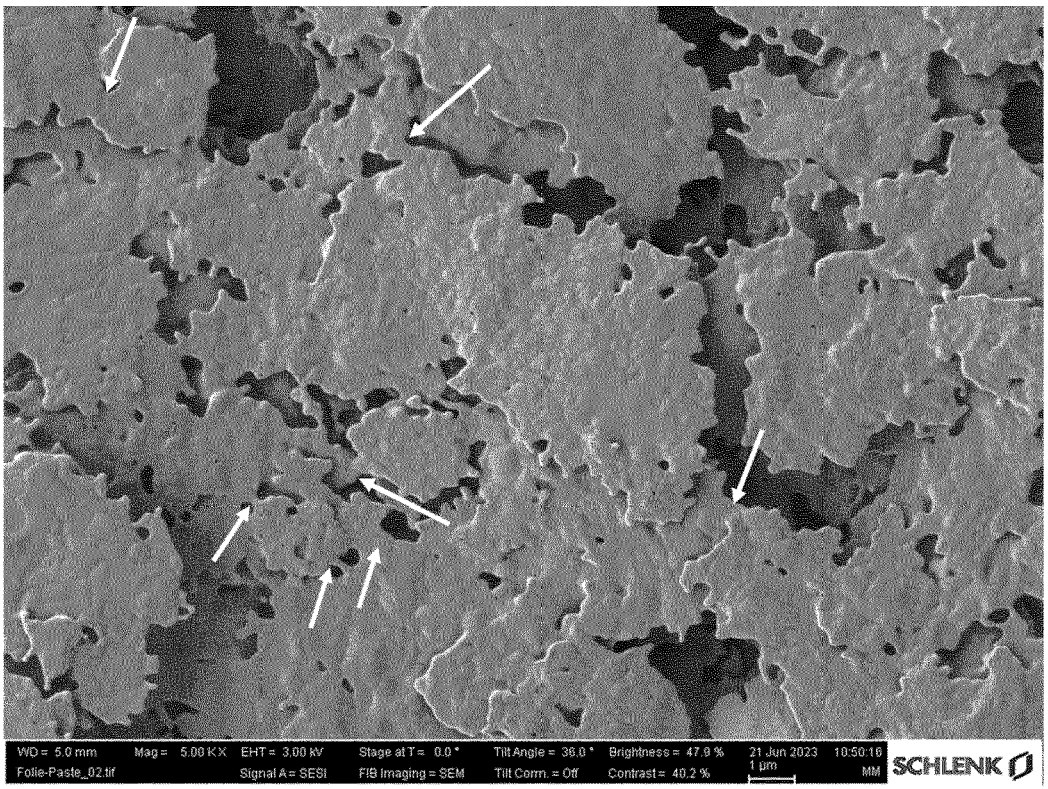
Figure 6:
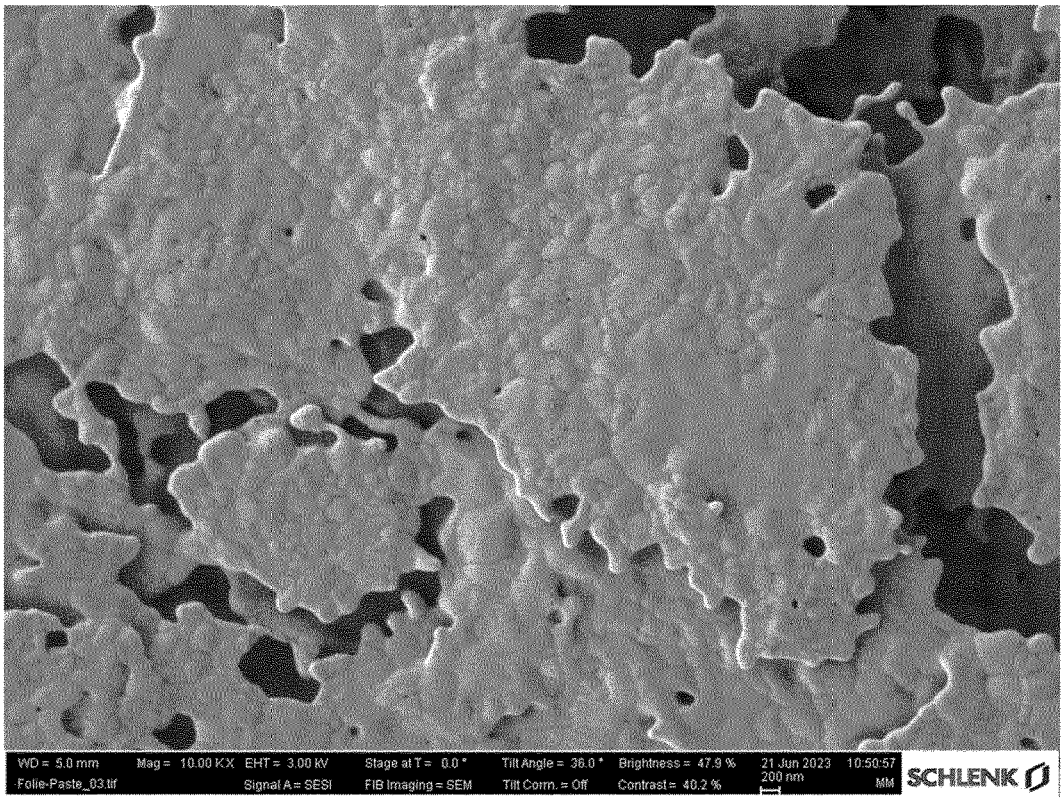
FIG. 6 shows that the flakes have a very fine grain structure on the surface. Electron Backscatter Diffraction (EBSD) analysis of the grain structure showed a preference for the [101] grain orientation relative to surface normal.
Figure 7:
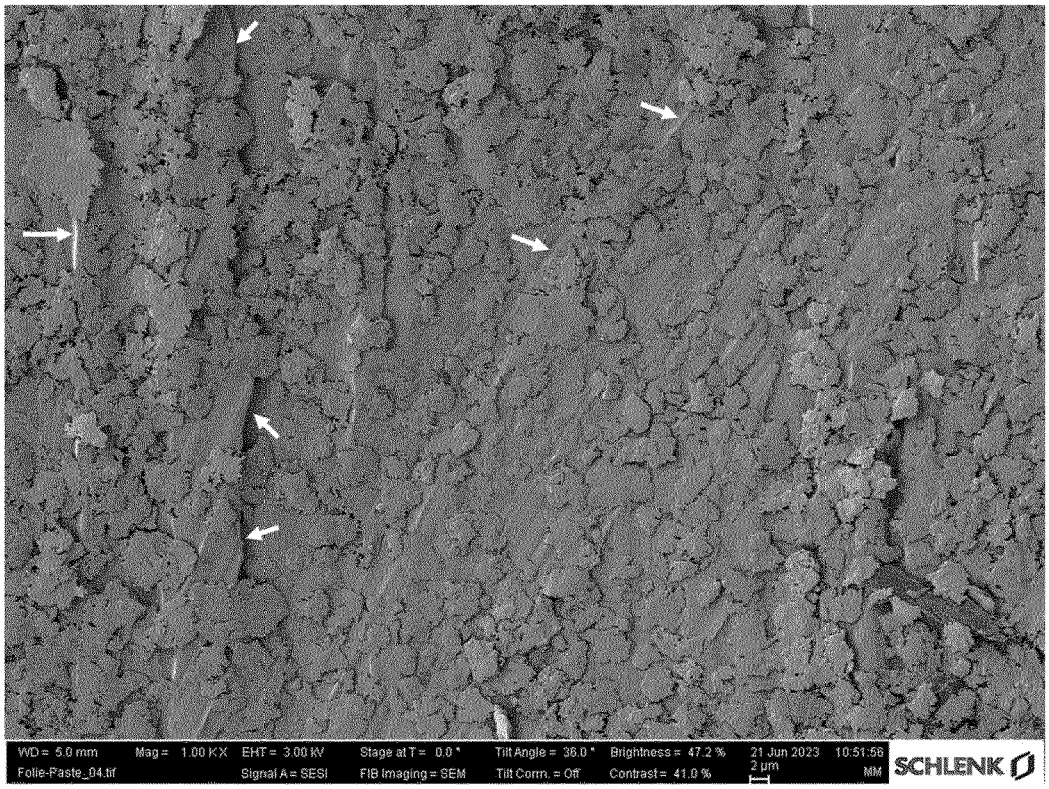
FIGS. 7 and 8 show a copper foil coated by a thin layer of flakes such that parts of the copper foil remain uncoated. Arrows added to FIG. 7 point to the uncoated part of the copper foil.
Figure 8:
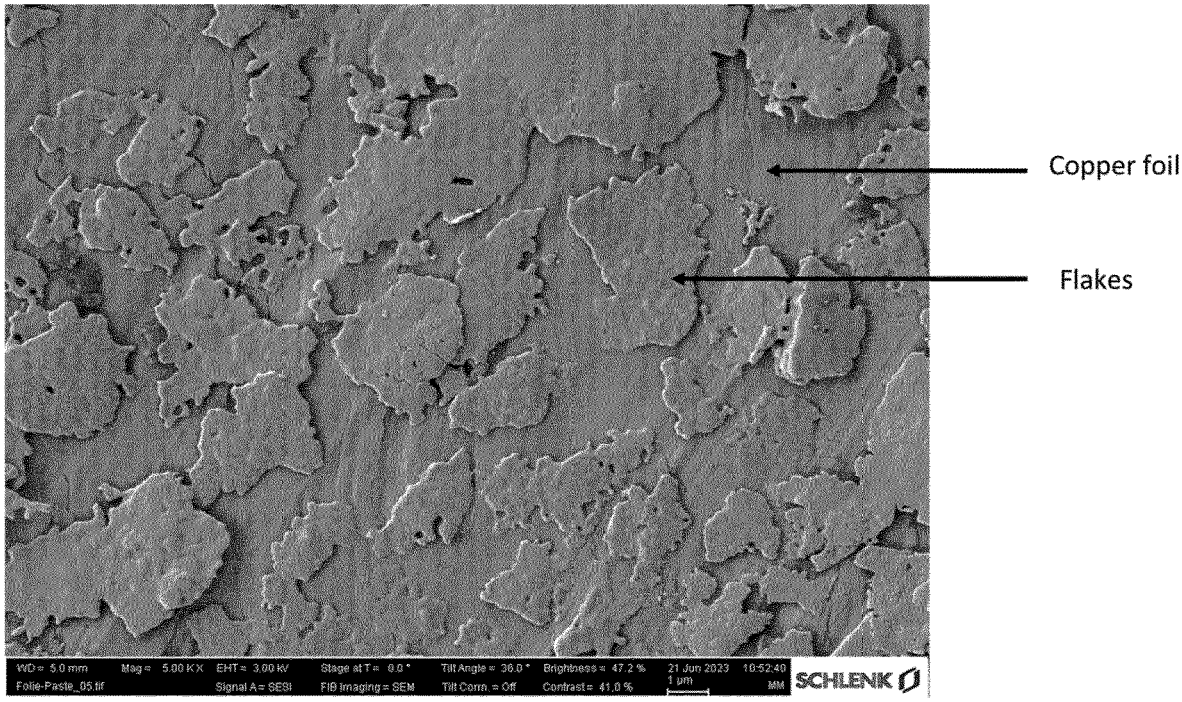
Figure 9:
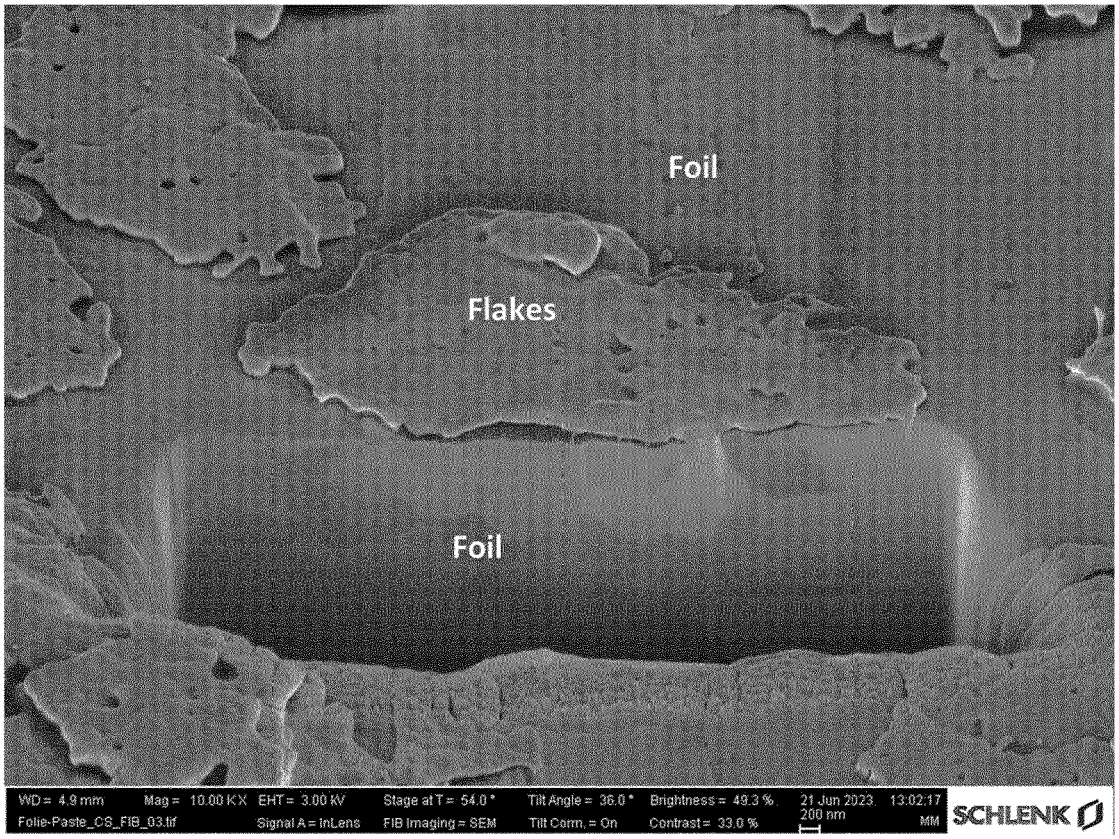
Figure 10:
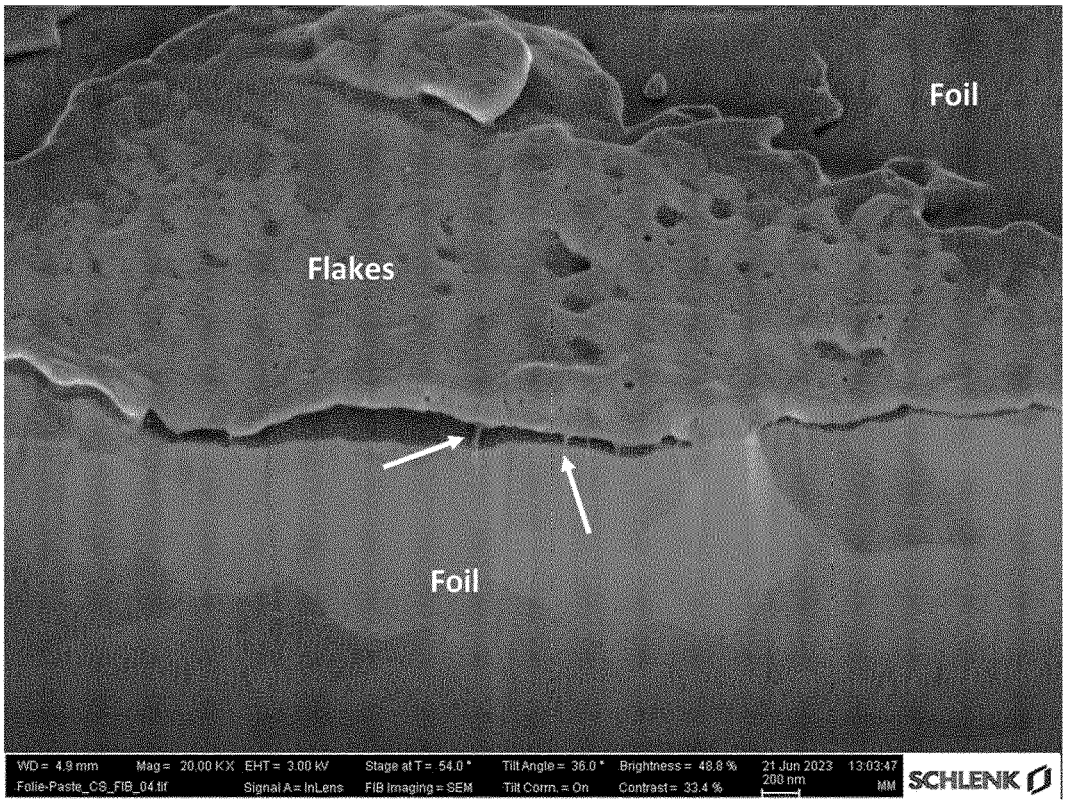
Figure 12:
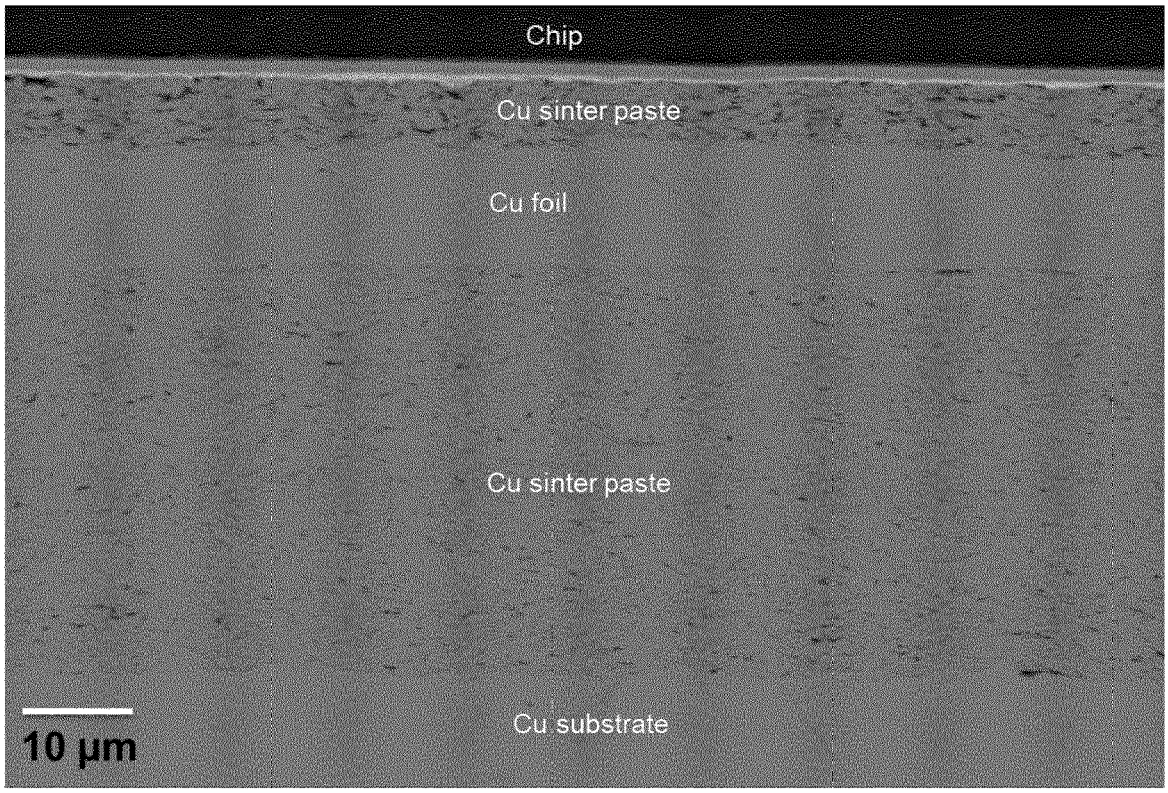
Figure 13:
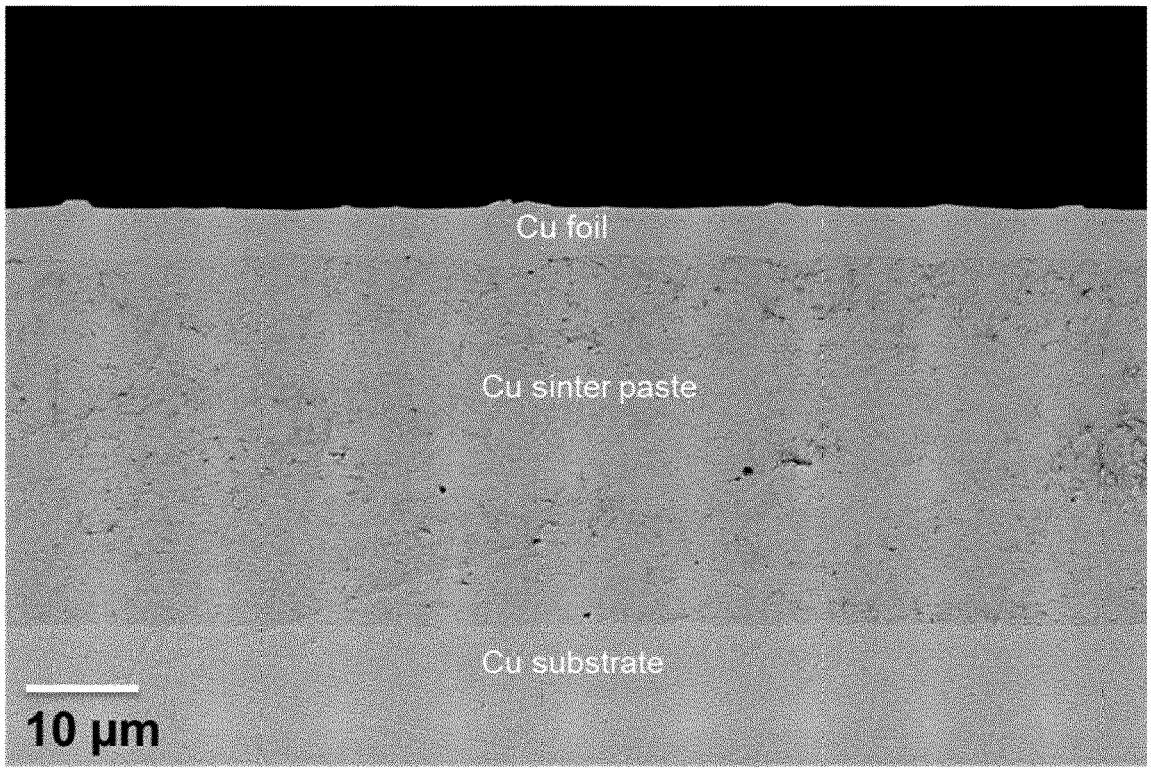
Figure 14:
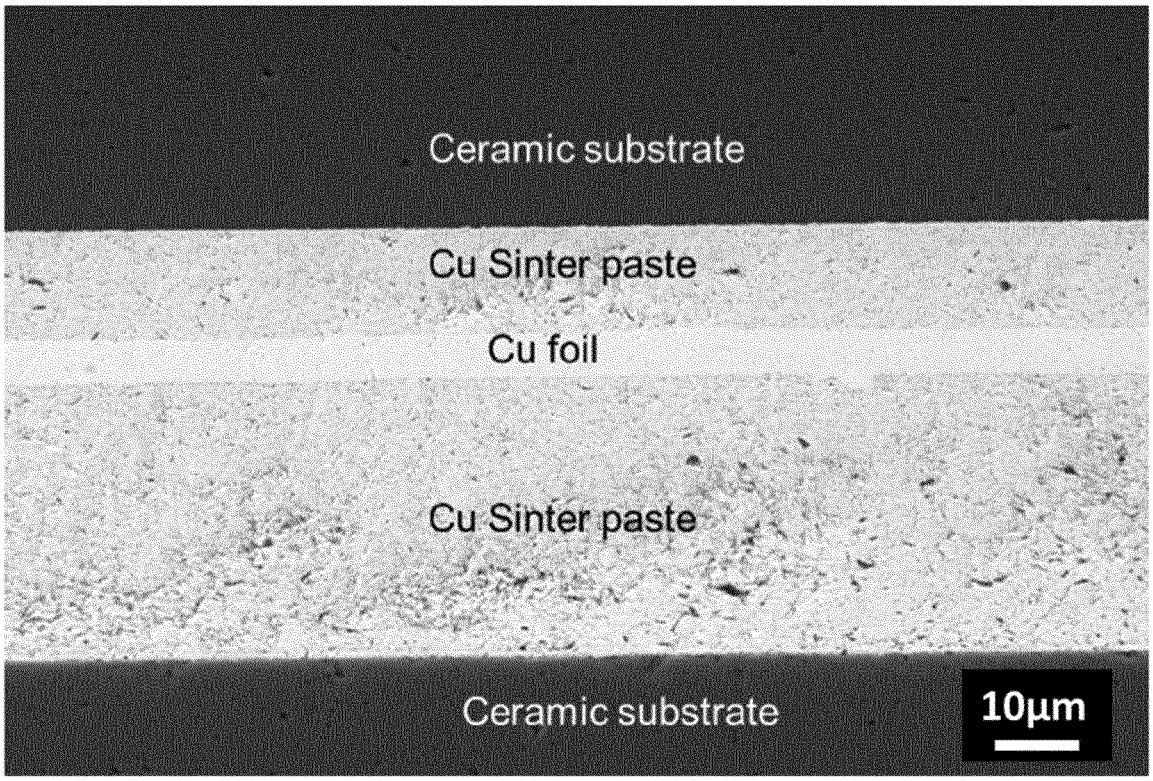

FIG. 9 shows single flakes sintered to the copper foil. The grain size on the flakes is substantially lower than on the foil. As is evident from FIG. 9, the grains on the foil are substantially larger (seen in combination with FIG. 3 where the grains on the flakes are in <50 nm range) and therefore a large energy gradient is created between the flakes and the foil. This enables an accelerated material transport through surface diffusion, allowing for sintering necks formation even under pressureless conditions as clearly observed in FIG. 10. A uniform application of bonding pressure is shown to increase the contact area between the flakes and the foil thus improving bonding between the flakes and the copper foil as can be seen in FIG. 12, FIG. 13 and FIG. 14. Arrows added to FIG. 10 point to sintering bridges formed between a flake and the foil.

Figure 11:
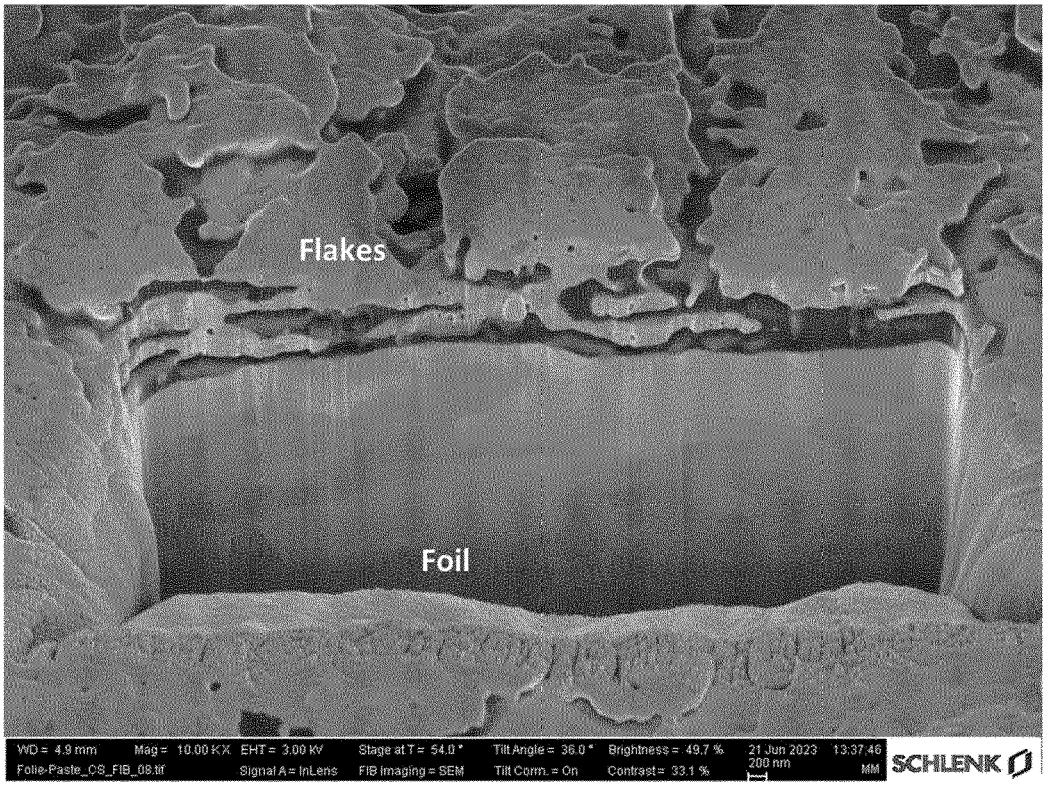

FIG. 11 shows that the flakes can stack over each other and connect to each other by sintering. Thus, the flakes provide the potential for a thin and homogeneous coating on the foil.

For the preparation of the sample shown in FIG. 12 the top side of the copper foil, i.e., the interface to the chip, was coated by spray coating as outlined above, since a thin layer is desired. However, on the bottom side, i.e., the interface to the substrate, a thick sinter layer between foil and substrate is desired. To achieve this, a thick layer of composition No. 1 was printed directly onto the bottom side of the copper foil with a manual coating process described above, after pre-drying the spray coated layer. Following this process, the manually coated layer is also predried and then the foil with a thin spray coated and pre-dried layer on one side and a thick manually coated and pre-dried layer on the other side is used as a sandwich to bond a chip to a bare copper substrate.

FIG. 12 shows an SEM image of a cross-section of the sintered interconnect demonstrating the possibility of applying different sinter paste thickness on either side of the foil and sintering of a test chip onto a bare copper substrate. Sintering was performed at 275° C. for 5 min under 1 MPa bonding pressure in an inert atmosphere in a SP300 sinter press of the company budatec GmbH, Melli-Beese-Straße 28, 12487 Berlin, Germany (as per Sample NO. 5 in the table 1 below).

FIG. 13 shows an SEM image of a cross-section of a sintered interconnect showing the possibility of bonding only the foil onto a bare copper substrate. Sintering was performed at 275° C. for 5 min under 1 MPa bonding pressure.

For the preparation of the sample shown in FIG. 14 a coated copper foil was prepared by applying the composition to the first surface of the copper foil in a thickness of 20 μm and to the second surface of the copper foil in a thickness of 75 μm followed by pre-drying. The composition No. 1 was manually coated as described above. First the paste was applied on one side, pre-dried at 120° C. for 5 min in air and then the composition was applied on the other side and once again pre-dried at 120° C. for 5 min in air. Finally the double side coated metal foil is placed on a first ceramic substrate by means of a pick-and-place machine for accurate placing. A second ceramic substrate with copper end metallization was then placed on the coated metal foil by means of a pick-and-place machine for accurate placing. Subsequently, sintering was performed under application of 2 MPa bonding pressure on the second substrate at 260° C. for 3 min in an open bond chamber with 3 L/min nitrogen flow with a ramp rate of 1 K/s on a Fineplacer Sigma flipchip bonder, from Finetech GmbH & Co. KG, Box-berger Str. 14, 12681 Berlin. A cross-section of the resulting interconnect is shown in FIG. 14.

As can be seen in FIG. 14, the composition layer between the first ceramic substrate and the copper foil and between the second ceramic substrate and the copper foil is reduced to a thickness of 10 μm to 15 μm and to 30 μm to 40 μm by sintering, respectively. The coated metal foil sintered between the ceramic substrates shows a homogenous and regular interconnect.

Example 8: Performing of Shear Tests

Dummy test chips having 1 $mm^2$ footprint with Au end metallization were sintered onto bare copper substrates through foils according to the invention. 10 samples were prepared per trial. The foils were prepared with a thin sinter layer of <5 μm on either side of 10 μm thick copper foils from Schlenk Metallfolien GmbH & Co. KG. Sintering was performed in an inert nitrogen atmosphere in the SP300 sinter press of the company budatec GmbH. After sintering, the shear tests were conducted as per the MLT-STD-883 test method (Mechanical test method 2019.5 Die shear strength). The arithmetic average shear strength value of the sintered interconnect was measured by a XYZ Condor Sigma Lite shear tester under a shear speed of 100 μm/s. Results are given in below Table 3.

TABLE 2

| Sample No. | Sintering temperature (° C.) | Sintering time (min) | Sintering pressure (kPa) | Shear strength (MPa) |
|---|---|---|---|---|
| 1 | 250 | 30 | 250 | 10.5 ± 1.3 |
| 2 | 275 | 30 | 250 | 12.6 ± 1.7 |
| 3 | 300 | 30 | 250 | 20.6 ± 1.5 |
| 4 | 275 | 15 | 2000 | 25.2 ± 1.7 |
| 5 | 275 | 5 | 10000 | 30.0 ± 1.5 |
| 6 | 250 | 5 | 10000 | 25 ± 4 |

Though only experiments with copper foil and copper flakes are exemplary shown above, the experiments were also performed with bronze foils and brass foils and flakes of bronze as well as flakes of brass. All these experiments gave similar results to the experiments described above.

The invention claimed is:

1. A coated metal foil for forming a copper-containing interlayer between a first solid substrate and a second solid substrate or between a solid substrate and the metal foil, wherein the coated metal foil comprises or consists of a metal foil of copper or of a first copper alloy or of a copper plated nickel-iron alloy, wherein the metal foil has a first surface and a second surface, and a composition coated on the first surface and/or the second surface of the metal foil, wherein the composition comprises or consists of the following components:

an organic binder and flakes of copper, of the first copper alloy or of a second copper alloy, wherein the flakes comprise internal pores.

2. The coated metal foil according to claim 1, wherein the composition is coated on the first surface and a further composition is coated on the second surface, wherein the further composition comprises or consists of the organic binder or a further organic binder and the flakes or further flakes of copper, of the first copper alloy or of the second copper alloy, wherein the further flakes comprise internal pores.

3. The coated metal foil according to claim 1, wherein the flakes of copper, of the first copper alloy or of the second copper alloy have a mean intraparticle pore density in a range of 7 internal pores/$\mu m^2$ to 30 internal pores/$\mu m^2$.

4. The coated metal foil according to claim 1, wherein grains in the metal foil at the first surface and/or the second surface of the metal foil have an average grain size of at least 2 μm and at most 100 μm and/or grains in the flakes have an average grain size of at least 20 nm and at most 200 nm and/or wherein a ratio of the average grain size of the grains in the flakes to the average grain size of the grains at the first surface and/or the second surface of the metal foil in each case does not exceed 0.002.

5. The coated metal foil according to claim 1, wherein the first copper alloy is bronze or brass and/or wherein the metal foil has a thickness of at least 5 μm and at most 150 μm.

6. The coated metal foil according to claim 1, wherein the flakes are of the second copper alloy and the second copper alloy is bronze or brass, and/or wherein the flakes have a mean particle size D50 determined by laser granulometry of at most 5 μm.

7. The coated metal foil according to claim 1, wherein the flakes have a multi-layer lamellar structure.

8. The coated metal foil according to claim 1, wherein the flakes are coated with stearic acid, wherein the total weight of stearic acid in relation to the total weight of the flakes coated with stearic acid at most 1.5 wt. %.

9. The coated metal foil according to claim 1, wherein the organic binder a terpineol, a primary alcohol, a diol, a triol, a polymeric glycol or a mixture of at least two of a terpineol, a primary alcohol, a diol, a triol and a polymeric glycol.

10. The coated metal foil according to claim 1, wherein the composition further comprise(s) turpentine or a polar organic solvent.

11. The coated metal foil according to claim 1, wherein 10% to 100%, of an area of the first surface and/or of an area of the second surface of the metal foil are independently from each other coated with the composition, and/or wherein the composition is coated on the first surface and/or the second surface of the metal foil in each case independently from each other in a thickness of at least 1 μm and at most 500 μm.

12. A method for producing the coated metal foil according to claim 1 comprising the steps of a) providing the metal foil of copper or of a first copper alloy or of a copper plated nickel-iron alloy, wherein the metal foil has a first surface and a second surface, the flakes of copper or of the first copper alloy or of a second copper alloy, wherein the flakes comprise internal pores, and the organic binder, b) mixing the flakes and the organic binder for obtaining a composition, and c) applying the composition obtained in step b) to the first surface and/or the second surface of the metal foil for obtaining the coated metal foil.

13. The method according to claim 12, wherein the metal foil is of bronze or brass and/or has a thickness of at least 5 μm and at most 150 μm, and/or the flakes are of the second copper alloy and the second copper alloy is bronze or brass, and/or the flakes have a mean particle size D50 determined by laser granulometry of at most 5 μm and/or the flakes have a multi-layer lamellar structure and/or the flakes are coated with stearic acid, wherein the total weight of stearic acid in relation to the total weight of the flakes coated with stearic acid is at most 1.5 wt. % and/or the organic binder is a terpineol, a primary alcohol, a diol, a triol, a polymeric glycol or a mixture of at least two of a terpineol, a primary alcohol, a diol, a triol and a polymeric glycol.

14. The method according to claim 12, wherein before step c) the metal foil is heated to a first pre-treatment temperature in the range of 170° C. to 220° C. for at least 1 minute and at most 2 hours and cooled to a second pre-treatment temperature in the range of 15° C. to 40° C.

15. The method according to claim 12, wherein after step c) the metal foil is heated to a pre-drying temperature in the range of 100° C. to 160° C. for at least 1 minute and at most 30 minutes or wherein during step c) and after the composition obtained in step b) was applied to the first surface, the metal foil is heated to a pre-drying temperature in the range of 100° C. to 160° C. for at least 1 minute and at most 30 minutes followed by a cooling step, application of the composition obtained in step b) to the second surface and heating the metal foil to the pre-drying temperature in the range of 100° C. to 160° C. for at least 1 minute and at most 30 minutes.

16. Use of the coated metal foil according to claim 1 for forming a copper-containing interlayer between two surfaces of solid substrates or between a surface of a solid substrate and the metal foil, for forming a conductive path on a solid substrate or for substrate attachment.

* * * * *